US011535967B2

(12) United States Patent
Ko et al.

(10) Patent No.: US 11,535,967 B2
(45) Date of Patent: Dec. 27, 2022

(54) WASHING MACHINE AND OPERATING METHOD OF WASHING MACHINE

(71) Applicant: LG Electronics Inc., Seoul (KR)

(72) Inventors: Soyeon Ko, Seoul (KR); Sujin Ahn, Seoul (KR); Sunju Lee, Seoul (KR); Jina Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 247 days.

(21) Appl. No.: 16/754,315

(22) PCT Filed: Sep. 14, 2018

(86) PCT No.: PCT/KR2018/010812
§ 371 (c)(1),
(2) Date: Apr. 7, 2020

(87) PCT Pub. No.: WO2019/074218
PCT Pub. Date: Apr. 18, 2019

(65) Prior Publication Data

US 2020/0240066 A1 Jul. 30, 2020

(30) Foreign Application Priority Data

Oct. 12, 2017 (KR) ..... 10-2017-0132784

(51) Int. Cl.
*D06F 34/00* (2020.01)
*D06F 34/32* (2020.01)
(Continued)

(52) U.S. Cl.
CPC ..... *D06F 34/32* (2020.02); *D06F 33/37* (2020.02); *D06F 39/02* (2013.01);
(Continued)

(58) Field of Classification Search
None
See application file for complete search history.

(56) References Cited

U.S. PATENT DOCUMENTS 8,978,186 B2 * 3/2015 Veening ..... A47L 15/006 68/12.18
2012/0056827 A1 * 3/2012 Kim ..... D06F 34/32 345/173
(Continued)

FOREIGN PATENT DOCUMENTS

CN 101068973 11/2007
CN 102385332 3/2012
(Continued)

OTHER PUBLICATIONS

Office Action in Korean Appln. No. 10-2017-0132784, dated Sep. 16, 2021, 13 pages (with English translation).
(Continued)

*Primary Examiner* — Cristi J Tate-Sims
(74) *Attorney, Agent, or Firm* — Fish & Richardson P.C.

(57) ABSTRACT

A washing machine and an operating method thereof are disclosed. A washing machine according to an embodiment of the present invention comprises: a washing tub; a touch screen for outputting a graphical object corresponding to a washing-related function which can be performed by the washing tub; a detergent supplying unit which is formed to receive a laundry detergent in an inner space thereof and supply the received laundry detergent to the washing tub through a supply fluid path; and a control unit which detects a load and a contamination level of laundry in response to input of a washing start command and determines an input quantity of the laundry detergent received in the detergent supplying unit on the basis of the detected load and contamination level. In addition, the control unit displays a graphical object related to the determined laundry detergent input quantity on the touch screen.

20 Claims, 15 Drawing Sheets

(51) Int. Cl.

| | |
|---|---|
| *D06F 103/02* | (2020.01) |
| *D06F 103/04* | (2020.01) |
| *D06F 103/18* | (2020.01) |
| *D06F 105/42* | (2020.01) |
| *D06F 105/56* | (2020.01) |
| *D06F 33/37* | (2020.01) |
| *D06F 39/02* | (2006.01) |

(52) U.S. Cl.
CPC ..... *D06F 2103/02* (2020.02); *D06F 2103/04* (2020.02); *D06F 2103/18* (2020.02); *D06F 2105/42* (2020.02); *D06F 2105/56* (2020.02)

(56) References Cited

U.S. PATENT DOCUMENTS

| | | | | |
|---|---|---|---|---|
| 2012/0090099 | A1* | 4/2012 | Kim | D06F 33/36 8/137 |
| 2015/0152584 | A1 | 6/2015 | Gasparini et al. | |
| 2015/0169194 | A1 | 6/2015 | Ban et al. | |
| 2015/0299927 | A1* | 10/2015 | Kim | D06F 29/00 68/27 |
| 2017/0233931 | A1 | 8/2017 | Lee | |
| 2019/0153648 | A1* | 5/2019 | Clayton | D06F 37/06 |

FOREIGN PATENT DOCUMENTS

| | | |
|---|---|---|
| CN | 104771086 | 7/2015 |
| CN | 105264137 | 1/2016 |
| CN | 105986398 | 10/2016 |
| DE | 102008005363 | 10/2008 |
| EP | 3042991 | 7/2016 |
| JP | H078676 | 1/1995 |
| JP | 2012024513 | 2/2012 |
| JP | 2015058243 | 3/2015 |
| KR | 20040008591 | 1/2004 |
| KR | 20060042569 | 5/2006 |
| KR | 20080092199 | 10/2008 |
| KR | 20100034925 | 4/2010 |
| KR | 101146280 | 5/2012 |
| KR | 20120085405 | 8/2012 |
| KR | 20120086063 | 8/2012 |
| KR | 20130106241 | 9/2013 |
| KR | 20150027643 | 3/2015 |
| KR | 20160039872 | 4/2016 |
| WO | WO2014193157 | 12/2014 |
| WO | WO2016102014 | 6/2016 |
| WO | WO2016180001 | 11/2016 |

OTHER PUBLICATIONS

Office Action in Chinese Appln. No. 201880066748.8, dated Nov. 30, 2021.

EP Extended European Search Report in European Appln. No. 18867232.3, dated May 10, 2021, 11 pages.

Office Action in Korean Appln. No. 10-2017-0132784, dated Mar. 28, 2022, 13 pages (with English translation).

* cited by examiner

WASHING MACHINE AND OPERATING METHOD OF WASHING MACHINE

CROSS-REFERENCE TO RELATED APPLICATIONS

This application is a National Stage application under 35 U.S.C. § 371 of International Application No. PCT/KR2018/010812, filed on Sep. 14, 2018, which claims the benefit of Korean Application No. 10-2017-0132784, filed on Oct. 12, 2017. The disclosures of the prior applications are incorporated by reference in their entirety.

FIELD

The present disclosure relates to a washing machine capable of automatically introducing laundry detergent, and a method of operating the same.

BACKGROUND

A washing machine includes an apparatus for washing clothes or laundry, and an apparatus for washing and drying clothes together. Washing clothes is a stroke of removing contaminants from the clothes through reaction between water and detergent, and drying clothes is a stroke of removing moisture contained in the clothes by use of a hot air supply device, for example.

A general washing machine includes a main body having a clothes inlet, a clothes accommodating unit provided in the main body, a driving unit to rotate a drum constructing the clothes accommodating unit, a door to open and close the clothes inlet, and a control unit to provide visual information related to strokes processed in the washing machine to the user and receive a user operation.

In the general washing machine, the door is designed to perform its original function of opening and closing the clothes inlet and allowing the user to look into the clothes accommodating unit therethrough. In addition, the control unit is usually provided in the main body, and is provided with a plurality of buttons and knobs for briefly displaying only predetermined strokes in a power-on/off manner and operating the strokes. This differentiation of the door and the control unit spoils simple appearance of the washing machine, and input and output interfaces between the washing machine and the user have no choice but to stay in a low dimensional manner. Therefore, in recent years, researches for implementing a control unit with a touch screen have been actively conducted.

On the other hand, in order to alleviate inconvenience that a user has to put laundry detergent by himself or herself every time of washing, a washing machine that is configured to automatically introduce the laundry detergent has been developed. However, a general washing machine having such a function of automatically injecting or introducing laundry detergent merely depends on a quantity of laundry to be washed, which lowers accuracy of a quantity of laundry detergent to be introduced or input. Therefore, if the user is forced to adjust the quantity of laundry detergent to be introduced every time, the user feels inconvenient and an advantage of automatic input of the laundry detergent disappears.

DISCLOSURE

Technical Problem

Therefore, one aspect of the present disclosure is to provide a washing machine capable of accurately adjusting a quantity of laundry detergent to be automatically introduced according to a state of laundry even without a user's manipulation, and a method of operating the same.

Another aspect of the present disclosure is to provide a washing machine capable of allowing a user to easily check and feedback an introduction or input of laundry detergent even while washing is carried out, and a method of operating the same.

Still another aspect of the present disclosure is to provide a washing machine capable of performing various operations related to automatic input of laundry detergent and interacting with a user according to a remaining quantity of the laundry detergent, and a method of operating the same.

Technical Solution

According to an embodiment of the present disclosure to solve those technical problems, a washing machine may include a washing tub, a touch screen configured to output a graphic object corresponding to a washing related function which is executable in the washing tub, a detergent supplying unit configured to accommodate a laundry detergent in an inner space thereof and to supply the accommodated laundry detergent to the washing tub through a supply passage, and a control unit configured to detect a load and contamination level of laundry in response to an input of a washing start command, and to determine an input quantity of the laundry detergent accommodated in the detergent supplying unit based on the detected load and contamination level. Also, the control unit may control the touch screen to display a graphic object associated with the determined input quantity of the laundry detergent.

In one embodiment, the touch screen may display a first graphic object thereon at a time point when the input quantity of the laundry detergent is determined, and display a second graphic object associated with the first graphic object thereon while the laundry detergent accommodated in the detergent supplying unit is introduced into the washing tub.

In one embodiment, the second graphic object may output thereon an image that changes depending on a degree to which the laundry detergent accommodated in the detergent supplying unit is introduced into the washing tub.

In one embodiment, the control unit may determine an initial input quantity of the laundry detergent based on the detected load of the laundry and determine whether to additionally input the laundry detergent based on the detected contamination level when the contamination level of the laundry is detected.

In one embodiment, the control unit may change a preset washing stroke based on the determined input quantity of the laundry detergent, and the detected load and contamination level of the laundry.

In one embodiment, the control unit may output screen information corresponding to the changed washing stroke on the touch screen.

In one embodiment, the control unit may change a quantity of the laundry detergent to be input when a touch input is applied to a graphic object associated with the determined input quantity of the laundry detergent while the graphic object is displayed.

In one embodiment, the washing machine may further include a sensor unit configured to detect a remaining quantity of the laundry detergent accommodated in the detergent supplying unit, and the control unit may output information related to the detected remaining quantity of the laundry detergent on the touch screen, in response to the input of the washing start command.

In one embodiment, when the input quantity of the laundry detergent is determined, the control unit may determine whether there is a shortage of the laundry detergent to be introduced based on the detected remaining quantity of the laundry detergent, and determine whether to continue a washing stroke based on the determination.

In one embodiment, the control unit may continue a washing stroke of the washing tub when the input quantity of the laundry detergent is determined and a shortage of the laundry detergent to be input based on the detected remaining quantity of the laundry detergent is larger than or equal to a reference value, and control the touch screen to output a notification to add the laundry detergent after completion of washing.

In one embodiment, the control unit may stop a washing stroke of the washing tub when the input quantity of the laundry detergent is determined and a shortage of the laundry detergent to be input based on the detected remaining quantity of the laundry detergent is smaller than a reference value.

In one embodiment, the sensor unit may include a sensor configured to sense a user's proximity, and the control unit may output screen information for inducing an addition of the laundry detergent into the detergent supplying unit to the touch screen, in response to the user's proximity being detected after the washing stroke of the washing tub is stopped.

In one embodiment, the washing machine may further include a communication unit configured to perform communication with a registered user terminal, and the control unit may transmit a control signal for outputting a screen related to a purchase of the laundry detergent based on a user feedback to the registered user terminal, in response to the user's proximity being detected after the washing stroke of the washing tub is stopped.

A method for operating a washing machine having a touch screen according to one embodiment of the present disclosure may include detecting a load and a contamination level of laundry when a washing start command is input, determining an input quantity of laundry detergent to be introduced into a washing tub based on the detected load and contamination level, and displaying a graphic object associated with the determined input quantity of the laundry detergent on a screen.

Advantageous Effects

According to a washing machine and a method for operating the same according to embodiments of the present disclosure, if only a washing start command is input, a quantity of laundry detergent to be automatically input can be accurately adjusted according to a state of laundry without a user's manipulation and accordingly an optimal washing stroke course can be automatically reset. Therefore, by putting a quantity of laundry detergent suitable for the laundry, an excessive use of the detergent can be prevented and an individual stroke course can be automatically reset according to a detergent input quantity, which may result in enhancing washing efficiency.

Also, the user can visually and easily confirm a quantity of laundry detergent to be input and a time point when the laundry detergent is introduced during a washing stroke, through an image output on a touch screen. In addition, if necessary, the user can perform an interaction for additionally inputting detergent or taking off some of detergent by using an image output on the touch screen.

When a quantity of laundry detergent stored in the washing machine is insufficient, an alarm or notification can be provided to the user so that the user can easily recognize the shortage of the detergent, and also the purchase of the laundry detergent can be guided based on the user's feedback, thereby providing a convenient environment for the user.

BEST MODE FOR CARRYING OUT PREFERRED EMBODIMENTS

Hereinafter, a washing machine according to the present disclosure will be described in detail with reference to the accompanying drawings.

A singular representation may include a plural representation unless it represents a definitely different meaning from the context.

It will be understood that although the terms first, second, etc. may be used herein to describe various elements, these elements should not be limited by these terms. These terms are generally only used to distinguish one element from another.

The same or equivalent components may be provided with the same or similar reference numbers, even in different embodiments, and description thereof will not be repeated.

In describing the present disclosure, if a detailed explanation for a related known function or construction is considered to unnecessarily divert the gist of the present disclosure, such explanation has been omitted but would be understood by those skilled in the art.

The accompanying drawings are used to help easily understand the technical idea of the present disclosure and it should be understood that the idea of the present disclosure is not limited by the accompanying drawings. The idea of the present disclosure should be construed to extend to any alterations, equivalents and substitutes besides the accompanying drawings.

Figure 1A:
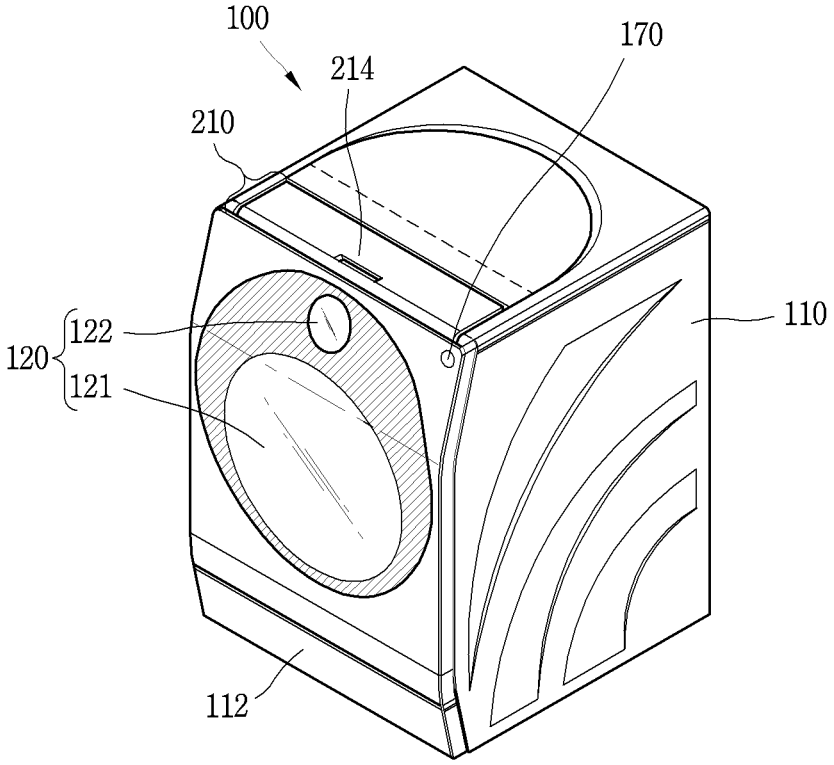
FIG. 1A is a perspective view of a washing machine in accordance with one embodiment of the present disclosure.
Figure 1B:
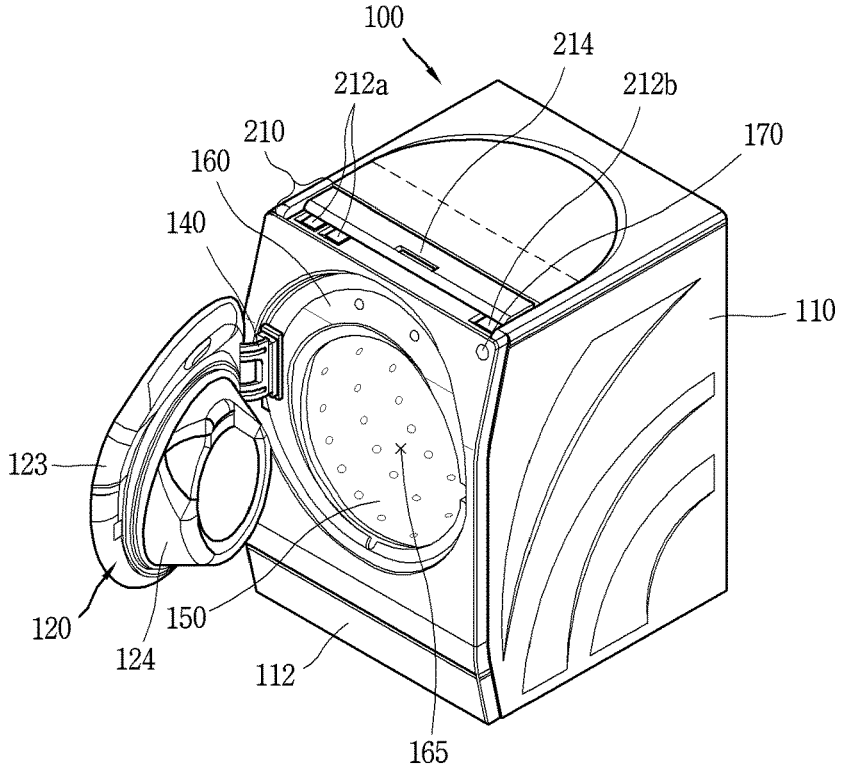
FIGS. 1B and 1C are conceptual views illustrating a state in which a door is opened and closed and a detergent supplying unit is drawn out, in a washing machine according to one embodiment of the present disclosure.
Figure 1C:
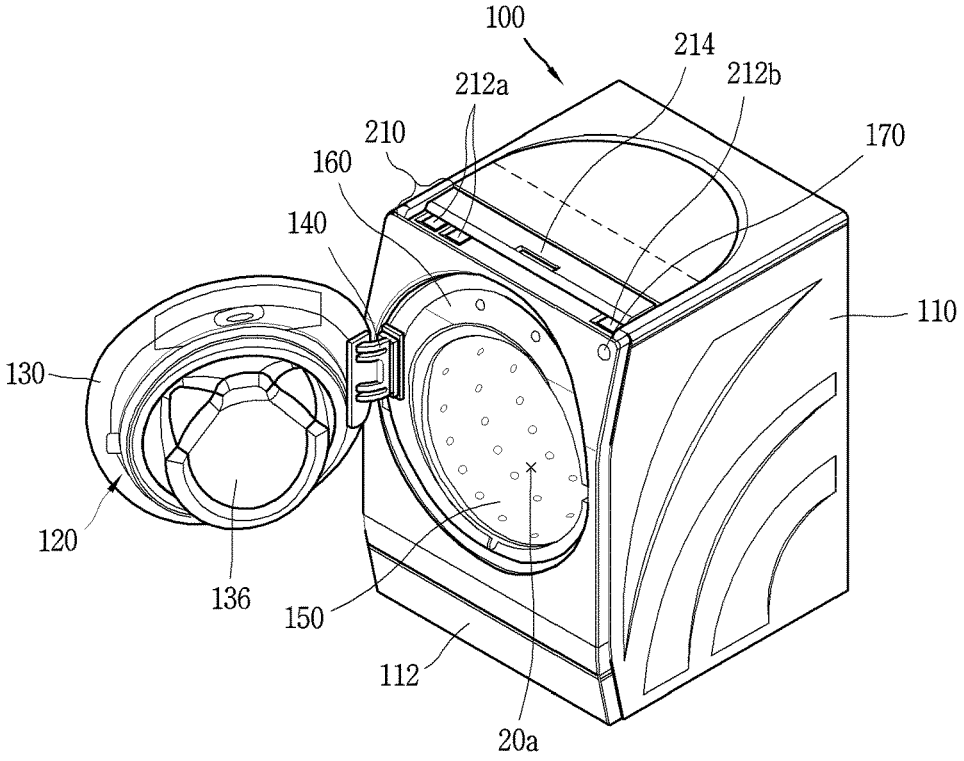

FIG. 1A is a perspective view of a washing machine 100 in accordance with one embodiment of the present disclosure, and FIGS. 1B and 1C are conceptual views illustrating states where a door 120 illustrated in FIG. 1A is rotated primarily and secondarily, so that a clothes inlet 160*a* is open and a detergent supplying unit 210 is slid to be open in a designated direction.

Referring to these drawings, the washing machine 100 includes a main body 110 and a door 120.

The main body 110 defines appearance of the washing machine 100 and has a clothes inlet 165 through which laundry is put into the washing machine. This embodiment illustrates that the clothes inlet 165 is formed through a front portion of the main body 110 having a hexahedral shape.

The main body 110 is provided therein with a clothes accommodating unit for receiving clothes or laundry through the clothes inlet 165. The clothes accommodating unit may be referred to as a 'washing tub'.

For example, when the washing machine 100 of the present disclosure is configured as an apparatus for drying clothes, the clothes accommodating unit may be configured as a drum 150 rotatably provided in the main body 110.

As another example, when the washing machine 100 of the present disclosure is configured as an apparatus by which washing and drying clothes are all carried out, the clothes accommodating unit may be provided with a tub (not illustrated) disposed in the main body 110 to store washing water, and a drum 150 rotatably disposed in the tub to accommodate clothes therein.

The main body 110 is provided with a driving unit (not illustrated) to rotate the drum 150. The driving unit may include a motor for generating driving force and a belt for rotating the drum 150 using the driving force. The drum 150 is rotated by rotational force generated in response to rotation of the motor, for example, at the time of detecting or sensing a weight of laundry, a washing stroke, a rinsing stroke, and a dehydrating stroke, so that the laundry accommodated therein can be washed, rinsed, and dehydrated. In addition, although not illustrated, the main body 110 is provided with a water supply device for supplying water. The water supply device includes a water supply pipe and a water supply valve. Here, one end of the water supply pipe is connected to an external water pipe (not shown) and another end is connected to a washing tub. Accordingly, water is supplied through the external water pipe and is guided into the drum 150 together with laundry detergent accommodated in a storage container of a detergent supplying unit. In addition, the water supply valve is opened and closed during the washing and rinsing strokes to control the supply of water into the drum 150.

A detergent supplying unit 210 may be provided on an upper surface of the main body 110 to be slidable in a vertical (up/down) direction. To this end, a handle 214 may be provided on the upper surface of the main body 110 to facilitate the detergent supplying unit 210 to be slid and moved up and down. The laundry detergent and softener may be filled and stored in the detergent supplying unit 210. Laundry detergents include both liquid and powder types, and contain all of materials, such as fabric detergent, fabric bleach, etc., which enhance washing effects.

Subsequently, referring to FIGS. 1B and 1C, the detergent supplying unit 210 may include a storage container which is provided with a detergent accommodating portion 212*a* in which laundry detergent is accommodated and a softener accommodating portion 212*b* in which liquid softener is accommodated. In addition, the detergent supplying unit 210 may include a laundry detergent supply passage (not shown) through which the laundry detergent and the liquid softener accommodated in the storage container are supplied into the washing tub, and a laundry detergent pump (not shown) provided in the laundry detergent supply passage.

The detergent accommodating portion 212*a* and the softener accommodating portion 212*b* may be partitioned from each other by a partition wall provided inside the storage container, so as to accommodate the laundry detergent and the softener, respectively. In addition, although not illustrated, each of the detergent accommodating portion 212*a* and the softener accommodating portion 212*b* may include an injection port stopper for opening and closing the injection port.

In addition, an installation space (not shown) for accommodating and installing the laundry detergent pump may be provided at the rear of the storage container. In addition, the laundry detergent supply passage may be formed at one side of the installation space, for example, at the rear of the installation space to supply the laundry detergent. In addition, the laundry detergent pump may include, for example, a detergent pump connected to the detergent accommodating portion 212*a* and a softener pump connected to the softener accommodating portion 212*b*. The laundry detergent supply passage may include a detergent supply passage for supplying laundry detergent and a softener supply passage for supplying a liquid softener. In addition, the laundry detergent and the liquid softener may be diluted in contact with water before being introduced into the washing tub and then supplied into the washing tub. With this configuration, since the laundry detergent is diluted with water and then is brought into contact with the laundry, there is no fear of laundry damage due to a direct contact of the laundry with the laundry detergent with high concentration.

In addition, a softener pump (not shown) is connected to communicate with the softener accommodating portion 212*b* of the storage container of the detergent supplying unit 210. The softener accommodating portion 212*b* may be provided with a softener pump connecting portion (not shown) for blocking leakage of softener from the softener accommodating portion 212*b*. On the other hand, when the storage container is opened in a vertical sliding manner as illustrated in the present disclosure, there is no worry about the leakage of the softener contained in the softener accommodating portion 212*b*, and thus the aforementioned components may be omitted.

The main body 110 may be provided with a power button 170 to power on/off the washing machine 100. When a display 122, which will be described later, is configured as a touch screen, the washing machine 100 may be powered on/off through a touch input applied to the touch screen 122.

In this case, the power button 170 is not provided, which may result in realizing simpler appearance of the washing machine.

The door 120 is rotatably installed on the main body 110 by a hinge unit 140 to open and close the clothes inlet 165. As illustrated, the main body 110 may include a door accommodating portion 160 recessed inwardly from an outer surface thereof and having the clothes inlet 165 therein. When the door 120 is closed, the door 120 is accommodated in the door accommodating portion 160 and an outer edge portion of the door 120 may be flush with an adjacent outer surface of the main body 110.

In order to prevent the door 120 from being stopped by the main body 110 when the door 120 is opened due to the structure in which the door 120 is accommodated in the door accommodating portion 160, the hinge unit 140 may have a double hinge structure having two different rotating axes. In this case, as illustrated in FIGS. 1B and 1C, the door 120 may be spaced apart from the door accommodating portion 160 by a primary rotation centering on one of the rotating axes, and then rotated by a secondary rotation centering on the other rotating axis.

In the structure in which the hinge unit 140 is mounted on one side of the door 120, a locking device for fixing or locking the door 120 to the main body 110 or releasing or unlocking the fixed/locked door 120 is provided on another side of the door 120. The locking device may be configured in a pressing manner, so that the door 120 is locked when the another side of the door 120 is pressed once and unlocked when the another side of the door 120 is pressed once again.

The door 120 is provided with a window 121 and a touch screen 122.

When the door 120 is closed, the window 121 is arranged to correspond to the clothes inlet 165 so that the user can look inside the clothes accommodating unit therethrough. Accordingly, the user can check the state of the clothes accommodated in the clothes accommodating unit through the window 121.

The touch screen 122 displays (outputs) information processed in the washing machine 100. For example, the touch screen 122 may display execution screen information of strokes (washing, dehydrating, drying, etc.) carried out in the washing machine 100, or UI (User Interface) and GUI (Graphic User Interface) information corresponding to the execution screen information.

The touch screen 122 is illustrated as being provided on the door 120, but is not limited thereto. For example, the touch screen 122 may be provided at any position of the top, side, or bottom surface of the main body, and may be provided at a plurality of positions.

Figure 1D:
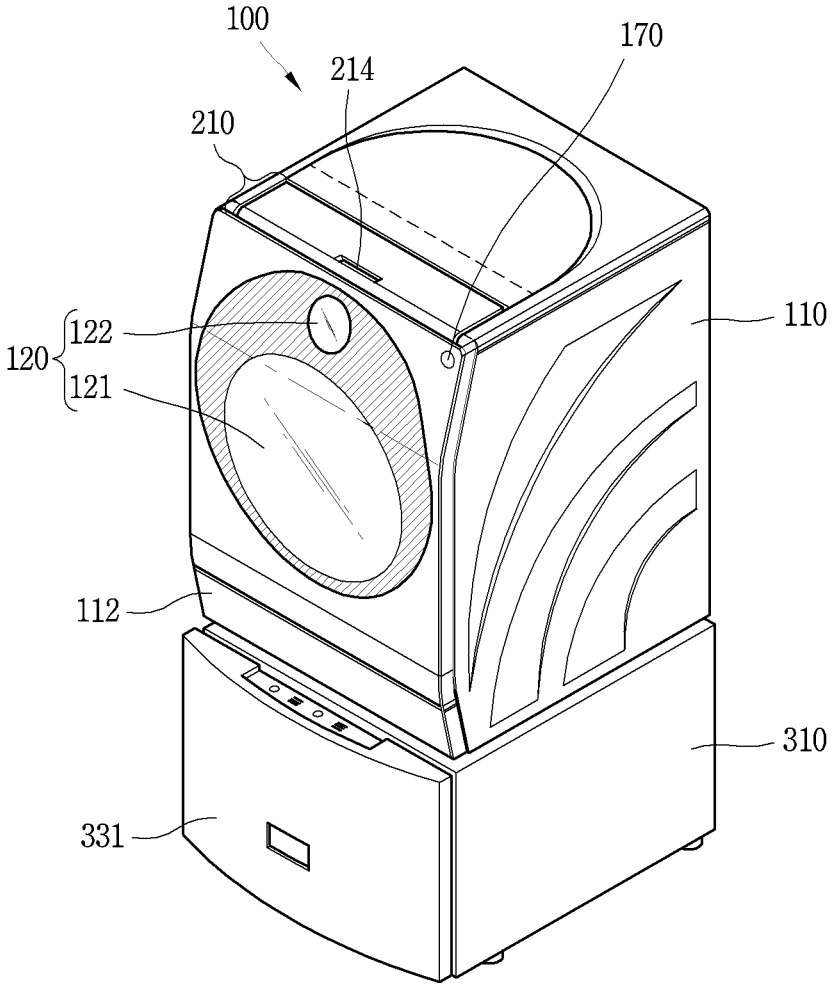
FIG. 1D is a perspective view of a washing machine in accordance with another embodiment of the present disclosure.

On the other hand, the washing machine 100 according to an embodiment of the present disclosure, as shown in FIG. 1D, may have a structure including a sub washer on the lower or one side of the main body 110. The washing machine 100 of FIG. 1D may include a first cabinet 110 defining appearance of a main washer and a second cabinet 310 defining appearance of a sub washer. At this time, the first cabinet 110 and the second cabinet 310 may be integrally formed with each other.

The sub washer may exist in various forms. For example, the sub washer may be configured as a top-load type washer or may have the same structure as or a different structure from that of the main washer. The sub washer may be configured in a manner that at least one of a washing capacity, a volume, and a height thereof is smaller than that of the main washer. Accordingly, the user can selectively use at least one of the main washer and the sub washer according to a quantity of laundry. In addition, the user may select at least one of the main washer and the sub washer according to a type of laundry.

The sub washer may include a second cabinet 310 defining appearance, a drawer housing pushed into or pulled out of the second cabinet 310, and a second washing tub provided in the drawer housing. In this case, the drawer housing may be pushed into or pulled out of the second cabinet 310 through an opening formed at the second cabinet 310 in a forward direction of the sub washer.

A cover panel 331 may be provided on the front of the drawer housing. The cover panel 331 may be integrally formed with the drawer housing. In addition, the cover panel 331 may be provided with a handle for pushing or pulling the drawer housing. In addition, a control panel for controlling the sub washer may be provided on an upper surface of the cover panel 331.

Figure 2:
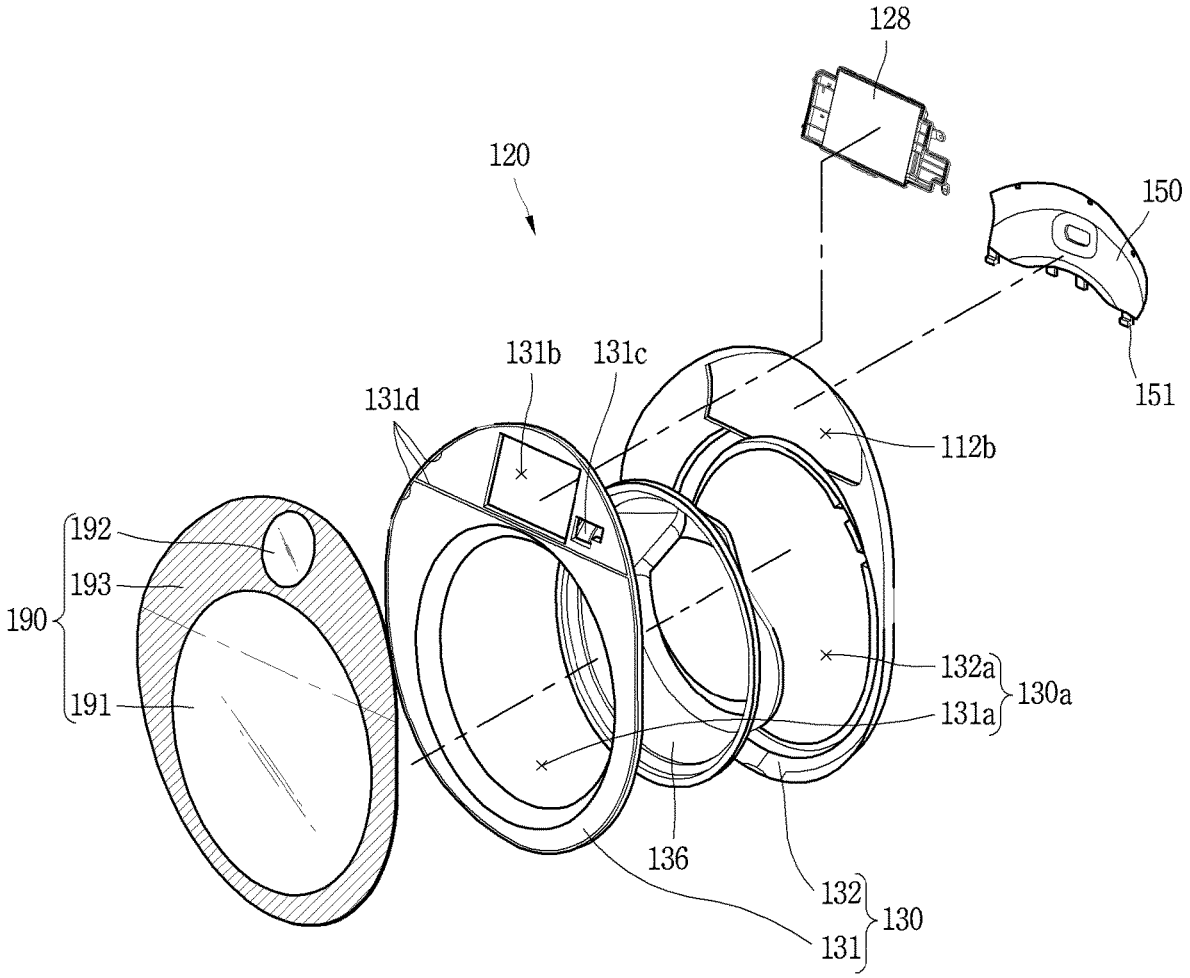
FIG. 2 is an exploded perspective view of the door illustrated in FIGS. 1A to 1D.

Hereinafter, a detailed structure of the door 120 will be described. FIG. 2 is an exploded perspective view of the door 120 illustrated in FIGS. 1A to 1C.

Referring to FIG. 2, the door 120 includes a door frame 130, a door window 136, a display module 128, and a door cover 190. As described above, the hinge unit 140 for coupling the door 120 to the main body 110 is mounted on the door 120, but the hinge unit 140 has been omitted in this drawing.

This embodiment illustrates that the door 120 is formed in a circular shape (including a perfect circular shape and an elliptical shape). However, the present disclosure is not limited thereto. The door 120 may be formed in a polygonal shape (square, hexagon, etc.).

The door frame 130 is rotatably coupled to the main body 110. To this end, the hinge unit 140 is coupled to the door frame 130 and the main body 110, respectively.

As illustrated, the door frame 130 may include an outer frame 131 and an inner frame 132. The outer frame 131 and the inner frame 132 may be formed of a synthetic resin material (for example, an acrylonitrile butadiene styrene (ABS) material, a polycarbonates (PC) material, or the like).

For reference, the reason why the aforementioned components are referred to as the outer frame 131 and the inner frame 132 is that the outer frame 131 faces the outside of the main body 110 and the inner frame 132 faces the inside of the main body 110 when only the door frame 130 is considered in the closed state of the door 120. Without this distinction, the outer frame 131 and the inner frame 132 may also be referred to as a first frame and a second frame, respectively.

The door frame 130 includes a first opening part 130*a* facing the clothes inlet 165 in the closed state of the door 120, and a second opening part 131*b* corresponding to the display module 128 mounted inside thereof. The first opening part 130*a* may also be referred to as a door window hole in that the door window 136 is provided therein and the second opening part 131*b* may also be referred to as a display hole in that the display module 128 is provided in the second opening part 131*b*. The second opening part 131*b* may be located above the first opening part 130*a*.

The first opening part 130*a* may include a front opening 131*a* formed at the outer frame 131 and a rear opening 132*a* formed at the inner frame 132. The second opening part 131*b* is formed at the outer frame 131. A communication portion 132*b* may be formed on the rear opening 132*a* of the inner frame 132 and the display module 128 may be mounted inside the door frame 130 through the communication portion 132*b*.

The door window 136 is installed on the door frame 130 to correspond to the first opening part 130*a*. The door window 136 is formed of a transparent material such as glass or synthetic resin and arranged to correspond to the clothes inlet 160*a* in the closed state of the door 120.

The display module 128 is installed inside the door frame 130. The display module 128 is arranged to correspond to the second opening part 131*b*. Visual information related to information processed in the washing machine 100 is output on the touch screen 122 provided on the display module 128.

A door cover 190, which defines outer appearance of the door 120, is coupled to the door frame 130. The door cover 190 may be made of a light-transmitting glass material or a synthetic resin material.

The door cover 190 includes an opaque region 193, and a first light-transmitting region 191 corresponding to the first opening part 130*a* and a second light-transmitting region 192 corresponding to the second opening part 131*b* within the opaque region 193. The first and second light-transmitting regions 191 and 192 are separated from each other by the opaque region 193. In this embodiment, the door frame 130 and the door cover 190 are formed in a circular shape so as to correspond to the circular door 120, and the first and second light-transmitting regions 191 and 192 are formed in a circular shape to provide an integrated aesthetic feeling to the user.

According to the present disclosure, a door cover can be provided with an opaque region, and first and second light-transmitting regions that are separated from each other in the opaque region, and a window and a display (or touch screen) can be provided in the first and second light-transmitting regions, respectively, to implement simple door appearance. In particular, when the first and second light-transmitting regions are formed in the circular shape so as to correspond to the circular door, an integrated aesthetic feeling can be provided to the user.

The door cover 190 may have at least one portion in a bent shape. For example, by the bent portion, a first cover portion and a second cover portion on both sides of the bent portion may be inclined relative to each other. Here, the first cover portion and the second cover portion are formed in a flat shape. In order to correspond to the door cover 190, the door frame 130 may also have at least one portion in a bent shape.

In this embodiment, the first light-transmitting region 191 is formed over the first cover portion and the bent portion, and the second light-transmitting region 192 is formed at the second cover portion.

On the other hand, the second light-transmitting region 192 is formed to be smaller than the second opening part 131*b* so that the door cover 190 is disposed in the second opening part 131*b* in an overlapping manner when the door cover 130 is coupled to the door frame 130.

As illustrated, the second opening part 131*b* may be formed in a rectangular shape corresponding to the rectangular display module 128, and the second light-transmitting region 192 may be formed in a circular shape to be disposed in the second opening part 131*b* in the overlapping manner. With the configuration, visual information can be output only through a portion corresponding to the circular second light-transmitting portion 192, and accordingly the user can be provided with the circular touch screen 122.

A circular display requires a higher price than a generally used rectangular display, and is difficult to be installed at an accurate position due to its shape, thereby frequently causing assembly defects. However, according to the structure, the touch screen 122, which requires a less cost and is seen as a circular shape to the user while using a rectangular display which can be assembled to an accurate position, can be provided.

Since the second light-transmitting region 192 is surrounded by the opaque region 193, visual information output on a portion of the touch screen 122, which does not correspond to the second light-transmitting region 192, is invisible to the user. In view of this, the visual information may not be output to the portion of the touch screen 122 that does not correspond to the second light-transmitting region 192.

For example, in a state in which visual information related to information processed in the washing machine 100 is output to the portion of the touch screen 122 corresponding to the second light-transmitting region 192, an outer image surrounding the visual information may be output to the portion which does not correspond to the second light-transmitting region 192. The outer image may be the portion which does not correspond to the second light-transmitting region 192 and may be filled with a specific color (for example, black).

As another example, in a state in which visual information related to information processed in the washing machine 100 is output to a portion of the touch screen 122 corresponding to the second light-transmitting region 192, the portion which does not correspond to the second light-transmitting region 192 may be turned off. That is, neither the outer image nor the visual information is output to the portion of the display module 128 that does not correspond to the second light-transmitting region 192. In this example, since only a part of the touch screen 122 is driven, the touch screen 122 can be efficiently driven, as compared with the foregoing example in which the entire touch screen 122 is driven, thereby achieving a power saving effect.

The touch screen 122 provided on the door cover 190 may be interlayered or integrated with a touch sensor (not illustrated), thereby implementing the touch screen 122 according to the present disclosure. The touch screen 122 may function as a user input unit for providing an input interface between the washing machine 100 and the user and simultaneously provide an output interface between the washing machine 100 and the user. For example, selection and change of an operation mode for performing several strokes such as washing, dehydrating, drying, and the like may be realized by a user's touch input (or touch) applied to the touch screen 122.

The touch screen 122 is provided with a touch sensor for sensing a touch input.

The touch sensor detects a touch input applied to the touch screen 122 using at least one of various touch methods such as a resistance film type, a capacitive type, an infrared type, an ultrasonic type, a magnetic field type, and the like.

As an example, the touch sensor may be configured to convert a change in pressure applied to a specific portion of the touch screen 122 or a capacitance generated in the specific portion to an electrical input signal. The touch sensor may be configured to detect position, area, pressure of a touch applied to the touch screen 122 by a touch object by which such touch is applied to the touch screen 122. Here, the touch object may be an object applying a touch to the touch screen 122, and examples of the touch object may include a finger, a touch pen, a stylus pen, a pointer, or the like.

Thus, if a touch input is applied to the touch screen 122, a signal(s) corresponding to the touch input is transmitted to a control device. The control device processes the signal(s) and transmits data corresponding to the processed signal to the control unit 180 (see FIG. 3). Accordingly, the control unit 180 may sense which region of the touch screen 122 has been touched. Here, the control device may be a separate configuration from the control unit 180 or may be the control unit 180 itself.

Meanwhile, the control unit 180 may execute the same control or a different control according to a type of touch object that touches the touch screen 122. Whether to perform a different control or the same control according to the type of touch object may be determined according to an operating state of the washing machine 100 or a currently-executed application program.

The touch screen 122 may sense various type of touch inputs, such as a short touch, a long touch, a multi touch, a drag touch, a flick touch, a pinch-in touch, a pinch-out touch, a swipe touch, a hovering touch, and the like.

The touch screen 122 is configured to sense a touch input applied to a sensing area including the second light-transmitting region 192.

This embodiment illustrates that the touch screen 122 is attached on the rear surface of the door cover 190 so as to cover the second light-transmitting region 192 and a part of the opaque region 193 surrounding the second light-transmitting region 192. With the configuration, the sensing area of the touch screen 122 includes not only the second light-transmitting region 192 but also the part of the opaque region 193 surrounding the second light-transmitting region 192. Accordingly, various UIs or GUIs using the part of the opaque region 193 surrounding the second light-transmitting region 192 can be provided.

In this structure, the touch sensor may be formed in the form of a touch film having a touch pattern, and may be disposed between the door cover 190 and the display module 128. The touch film may be made of a transparent conductive film, and well-known ITO film (Indium-Tin Oxide film) or CNT film (Carbon Nano Tube film) may be used as the touch film.

The touch film may be configured by one or two layers. For example, in the case of a type in which the touch film is provided with two layers [Glass-Film-Film (GFF)], the touch film may be attached to the rear surface of the door cover 190 or attached on the display module 128. As another example, in the case of a type [Glass-Film (GIF)] in which the touch film is provided with one layer, the touch film may be attached to the rear surface of the door cover 190 to be formed integrally with the door cover 190.

The touch sensor may also be formed in the form in which a metal wire is directly patterned on the rear surface of the door cover 190, without a separate touch film.

Alternatively, the touch sensor may be formed integrally with a display provided on the display module 128. For example, the touch sensor may be disposed on a substrate of the display (on-cell type) or in the display (in-cell type).

On the other hand, the present disclosure can also be applied to a case where the touch screen 122 is arranged at another position other than the door 120, as well as the case where the touch screen 122 is provided at the door 120. For example, the touch screen 122 may be provided on one surface of the main body 110, and the one surface may correspond to a surface where the power button 170 is disposed on the main body 110. However, for convenience of explanation, the case where the touch screen 122 is provided at the door 120 is described as an example, but the present disclosure is not limited thereto.

Figure 3:
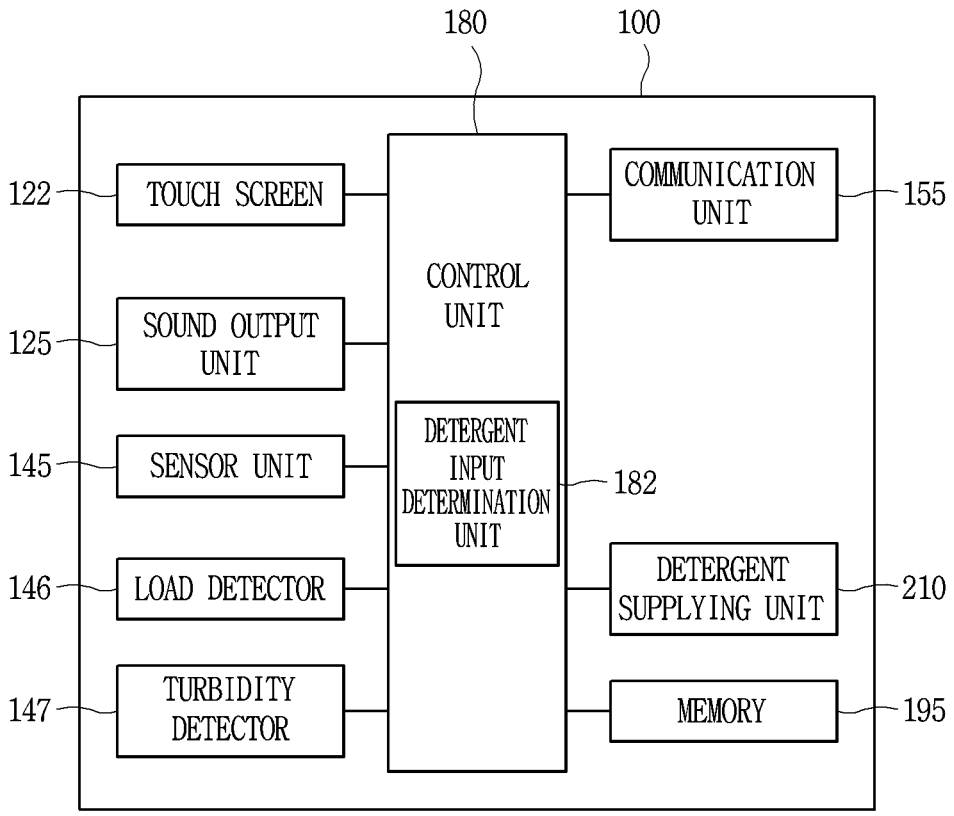
FIG. 3 is a block diagram illustrating a configuration of a washing machine in accordance with one embodiment of the present disclosure.

FIG. 3 is a block diagram illustrating a detailed configuration of a washing machine 100 in accordance with one embodiment of the present disclosure.

As illustrated in FIG. 3, the washing machine 100 may further include a control unit 180, a communication unit 155, a sound output unit 125, a sensor unit 145, a load detector 146, a turbidity detector 147, a detergent input determination unit 182, a detergent supplying unit 210 and a memory 195, in addition to the touch screen 122.

Specifically, the communication unit 155 may include a communication device that is configured to facilitate short-range communications. Suitable technologies for implementing such short-range communications may include Bluetooth, Radio Frequency IDentification (RFID), Infrared Data Association (IrDA), Ultra-WideBand (UWB), ZigBee, Near Field Communication (NFC), Wireless-Fidelity (Wi-Fi), Wi-Fi Direct, Wireless USB (Wireless Universal Serial Bus), and the like. For example, when a user terminal registered in the main body of the washing machine 100 approaches the washing machine 100, the washing machine 100 and the user terminal may perform wireless data communication through Bluetooth communication. Here, the user terminal may include, for example, a smart phone, a tablet, a notebook, an ultrabook, a wearable device, a watch type terminal, and the like.

The control unit 180 controls an overall operation of the washing machine 100. In addition, the control unit 180 may control operations of components provided in the washing machine 100, and process signals generated from those components.

The sound output unit 125 may be configured to output predetermined notification sound or voice when an event related to washing occurs. Herein, the event related to washing may include connection with an external device, power on/off, washing course setting, setting/change of individual strokes such as rinsing, dehydration and drying, start of washing, completion of washing, introduction or input of laundry detergent, a shortage of remaining laundry detergent, and the like.

The detergent supplying unit 210 supplies laundry detergent and softener accommodated in the inner storage container to the washing tub according to a determined quantity to be introduced. The detergent supplying unit 210 may be configured to have the storage container that is disposed at an upper surface of the main body 110 to be opened and closed in the form of a sliding door in the vertical direction, as illustrated in FIGS. 1A to 1D. Alternatively, although not shown, a storage container that can be pulled out or pushed in like a drawer may be provided at the front surface of the main body 110 or at a lower side of the main body.

The sensor unit 145 may typically be implemented using one or more sensors configured to sense internal information on the washing machine 100, surrounding environment information around the washing machine 100, user information, and the like. For example, the sensor unit 145 may include a sensor configured to detect opening and closing of the door 120, and the sensor may be disposed at one side of the door 120 or the hinge unit 140.

In addition, the sensor unit 145 may sense that the user approaches the washing machine 100 through a proximity sensor. The sensor unit 145 may also sense that a registered user terminal approaches the washing machine 100 through the proximity sensor.

The sensor unit 145 may further include a sensor for detecting or sensing a remaining quantity of laundry detergent and liquid softener accommodated in the storage container of the detergent supplying unit 210. Hereinafter, the sensor will be referred to as a 'remaining quantity detection unit'.

The remaining quantity detection unit, for example, may be disposed at an upstream side of a pressing space (not shown) according to a moving direction of the laundry detergent.

The remaining quantity detection unit, for example, may include an air pocket (not shown) communicating with the passage and temporarily accommodating therein air and laundry detergent, and an electrode (not shown) disposed to be in contact with the laundry detergent inside the air pocket. At this time, a lower portion of the air pocket, for example, may communicate with the passage of the laundry detergent so that the laundry detergent is temporarily accommodated, and also the air pocket may protrude upward to an upper side of the passage so that air can be accommodated above the laundry detergent. In addition, a cover surrounding the air pocket may be provided with another electrode (not shown) coming into contact with the laundry detergent moving along the passage. The electrode may be provided in pair, for example. Each of the pair of electrodes may be formed long in length such that a lower end thereof can be disposed below an upper end of a cross section of the passage. More specifically, each lower end of the electrodes may be disposed in a range lower than the upper end of the cross section of the passage and higher than a center of the cross section of the passage. Accordingly, the remaining quantity of the laundry detergent can be accurately detected.

On the other hand, the air pocket may have a volume larger than a volume of an introduction space (not shown). More specifically, the volume of the air pocket may be more than twice the volume of the introduction space. This may result in effectively preventing false detection of the remaining quantity of the laundry detergent caused due to bubbles generated during the movement of the laundry detergent. In more detail, air is stored in a compressed state inside the air pocket during the movement of the laundry detergent, thereby suppressing the bubbles generated due to the movement of the laundry detergent from moving upward along the electrode. This can prevent false detection of the remaining quantity caused due to the rise of the bubbles.

A process of inputting (injecting or introducing) laundry detergent will be described as follows. With the aforementioned configuration, when a laundry detergent input command determined from the control unit 180 is transmitted, an inlet port (not shown) may be opened. Accordingly, the laundry detergent inside the storage container included in the detergent supplying unit 210 may be introduced into an introduction space (not shown) through an introduction opening (not shown) and also flow into a pressing space (not shown) through the opened inlet port. When a discharge port (not shown) is opened by compression force of a piston, the laundry detergent (detergent, softener) subjected to the compression force by the piston may be moved along the laundry detergent supply passage through the discharge port into a bellows connection portion (not shown). The laundry detergent may be diluted with water and introduced into the washing tub. On the other hand, when the supply of the laundry detergent is completed in this way, the remaining quantity detection unit may detect the remaining quantity of the laundry detergent at the bottom of the air pocket.

Here, since air is collected in the air pocket during the movement of the laundry detergent and a relatively large amount of air is collected and compressed as time elapses, bubbles generated during the movement of the laundry detergent can be prevented from moving upward along the electrode. This may result in preventing the false detection of the remaining quantity of the laundry detergent, which results from that the bubbles other than the laundry detergent rise and comes in contact with the electrode when the remaining quantity of the laundry detergent is actually insufficient.

On the other hand, the load detector 146 detects a size (quantity) of laundry accommodated in the washing tub. Specifically, a weight of the laundry, namely, a load is detected in response to the rotation of the drum 150. When the load is detected, an initial water supply amount is determined based on the detected load.

The turbidity detector 147 detects a contamination level of laundry accommodated in the washing tub. For example, the turbidity detector 147 may detect a contamination level of laundry based on a contamination level (turbidity) of washing water.

The detergent input determination unit 182 determines a quantity of laundry detergent to be automatically input based on the load and contamination level of the laundry detected by the load detector 146 and the turbidity detector 147. The detergent input determination unit 182 may be included in the form of a circuit additionally provided inside the hardware control unit 180, or may be implemented as a separate independent hardware configuration.

The memory 195 may store information related to programs and operations related to washing. The memory 195, for example, may include at least one of storage mediums including a flash memory type, a hard disk type, a solid state disk (SSD) type, a silicon disk drive (SDD) type, a multimedia card micro type, a card-type memory (e.g., SD or DX memory, etc.), a Random Access Memory (RAM), a Static Random Access Memory (SRAM), a Read-Only Memory (ROM), an Electrically Erasable Programmable Read-Only Memory (EEPROM), a Programmable Read-Only memory (PROM), a magnetic memory, a magnetic disk, an optical disk, and the like.

The memory 195 may further store setting information (e.g., detergent type, input quantity, a number of inputs, etc.) related to automatic input (introduction) of laundry detergent, and the setting information may be updated when the setting information is changed based on a user input.

The washing machine 100 according to the present disclosure is configured to automatically input laundry detergent. When a washing start command is received, a load and a contamination level of the laundry are sequentially detected. At this time, the detection of the contamination level of the laundry may be carried out a plurality of times during washing. When the load and the contamination level of the laundry are detected, the control unit 180 of the washing machine 100 determines an input quantity of the laundry detergent accommodated in the detergent supplying unit 210 based on the detected load and contamination level of the laundry. At this time, a graphic object associated with the determined input quantity of the laundry detergent is displayed on the touch screen 122 of the washing machine 100. According to this, a quantity of laundry detergent to be automatically input can be accurately controlled according to a state of laundry without a user's manipulation, and an optimal washing stroke course can be automatically set. Also, the user can easily check information related to the introduction of the laundry detergent in a visual manner through the touch screen.

Figure 4:
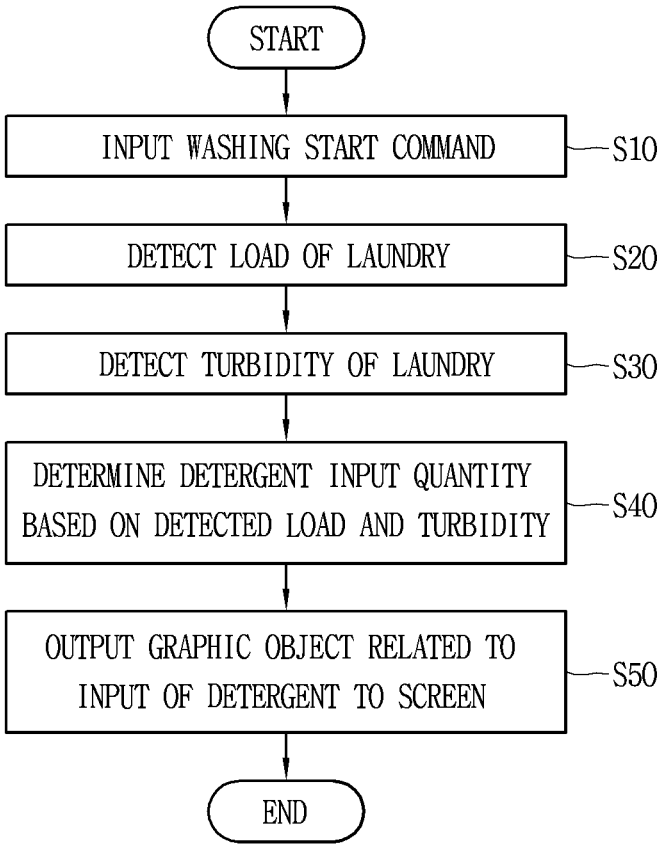
FIG. 4 is a representative flowchart illustrating operations of a washing machine in accordance with one embodiment of the present disclosure.

FIG. 4 is a representative flowchart illustrating an operation of a washing machine in accordance with one embodiment of the present disclosure, and FIGS. 5A, 5B, 5C, and 5D are exemplary conceptual diagrams illustrating in detail the operation of FIG. 4.

First, referring to FIG. 4, the washing machine 100 according to the present disclosure receives an input of a washing start command (S10).

Here, the input of the washing start command is an intentional input for starting washing. For example, it may mean that a push input has been applied to the power button 170 of the washing machine 100. Alternatively, the input of the washing start command may mean a case where the touch screen 122 is switched from an OFF state to an ON state, a home screen is output on the touch screen 122 or a touch is applied to a specific function icon on a home screen. Alternatively, the input of the washing start command may mean a case where a user approaching the washing machine 100 is detected by the proximity sensor or the like or the washing machine 100 is paired with a smart server 200 or a user terminal. Or, the input of the washing start command may mean a case where closing of the door 120 is detected after laundry is introduced into the washing tub.

Next, the control unit 180 of the washing machine 100 rotates the drum 150 according to the rotation of the motor, thereby detecting a quantity of laundry, that is, a load (S20). Then, a water supply amount is determined based on the detected load, and washing water is supplied into the washing tub.

Figure 5A:
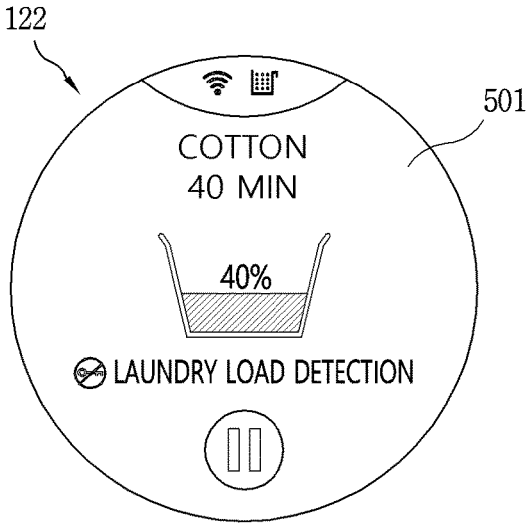
FIGS. 5A, 5B, 5C, and 5D are exemplary conceptual diagrams illustrating in detail the operations of FIG. 4.

FIG. 5A illustrates an example in which a first graphic object 501 indicating a size of a load is displayed on the touch screen 122 as the load of the laundry is detected. Although the first graphic object 501 expresses the detected load with respect to a maximum size or quantity in the form of percentage (%) (for example, 40%), the present disclosure is not limited thereto. The size of the load may alternatively be shown in the form of a bar graph, a specific number, or a color image represented along a circumference of a boundary. In addition, the first graphic object 501 may display therein a currently-executed washing operation (e.g., laundry load detection), an initially-set stroke course (e.g., cotton), and a corresponding washing time (e.g., 40 minutes).

On the other hand, while washing water is introduced into the washing tub, the laundry detergent may be introduced early as much as a determined quantity corresponding to the initially-set stroke course (e.g., standard wash, speed wash, mixed fabric wash, etc.) and setting information (e.g., reference input quantity of small/medium/large, whether softener is to be input, etc.).

Next, a contamination level (or turbidity) of the laundry is detected (S30). The contamination level of the laundry may be detected more than once during the washing stroke. Specifically, the contamination level of the laundry may be detected based on a contamination level of washing water. In addition, the control unit 180 may determine a final contamination level of the laundry by averaging a plurality of contamination level detection results.

In another example, a voice recognition function provided in the washing machine 100 may be activated to receive detailed information (e.g., 'normal', 'lightly', 'dirty') related to a contamination level by voice from the user, and calculate a total contamination level of the laundry or an average of individual contamination levels of the laundry.

In another example, a camera provided in the washing machine 100 may be activated to recognize the laundry or a QR code (or barcode) of the laundry. Accordingly, material and type of the laundry may be recognized to estimate type and level of contamination. For example, if the laundry is classified as 'training clothes' or 'baby clothes', it may be estimated that the contamination level is high.

Figure 5B:
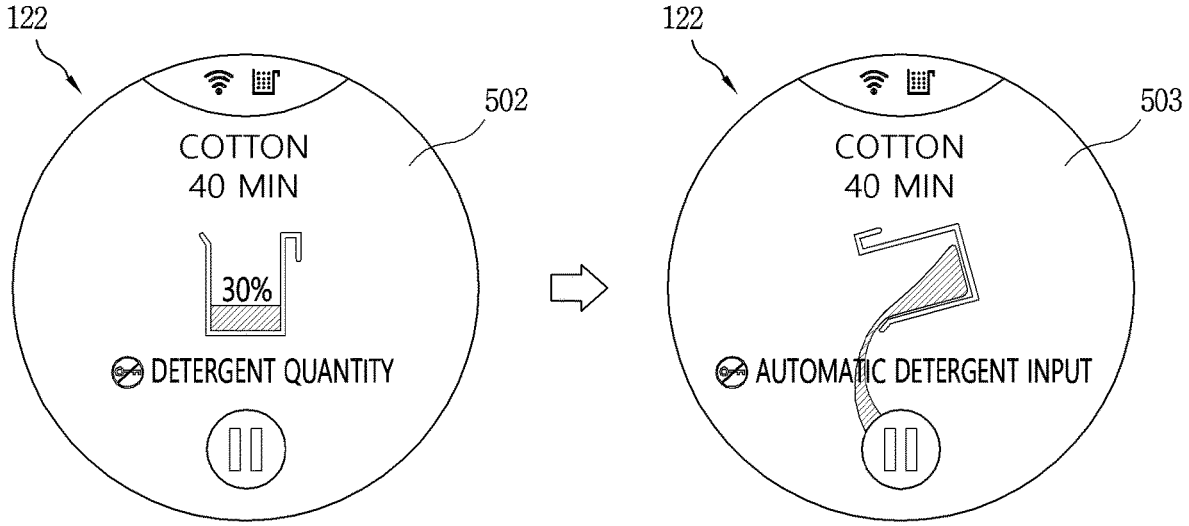
Figure 5C:
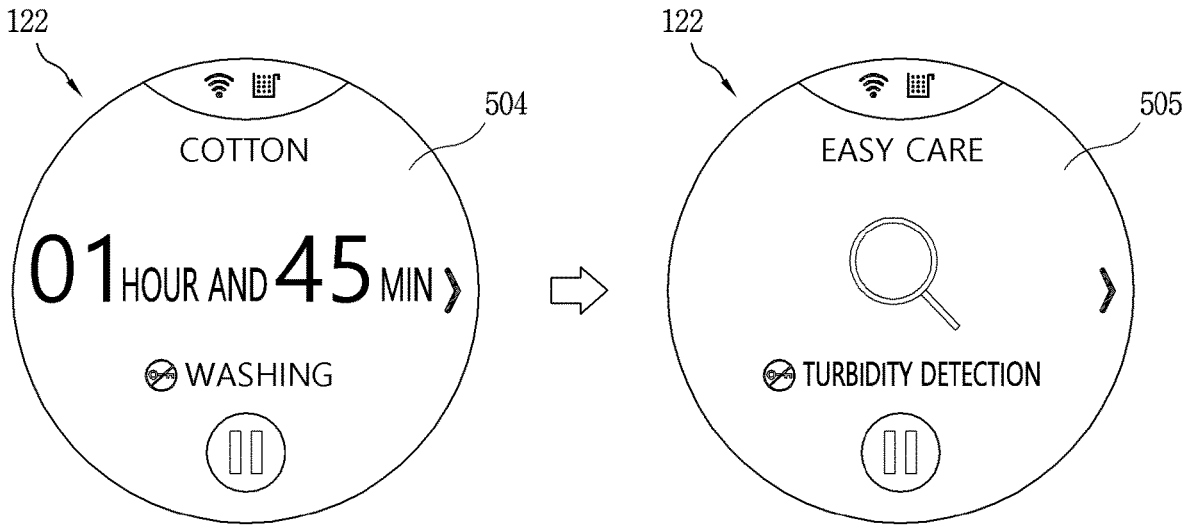
Figure 5D:
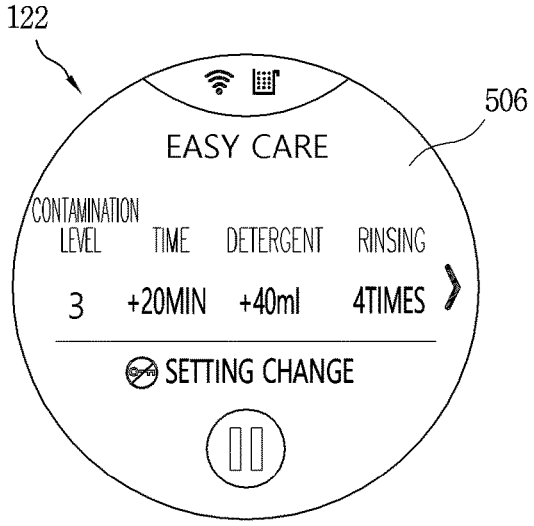

FIG. 5C illustrates an example in which a second graphic object 505 indicating a contamination level (turbidity) detected during the washing stroke is output on the touch screen 122. The output of the second graphic object 505 may be carried out as many times as the number of times of detecting the contamination level. While the contamination detection is not performed, information 504 indicating a washing time is output as shown in the left drawing of FIG. 5C. On the other hand, while the contamination detection is performed, the second graphic object 505 including an image indicating that the contamination detection is being performed is displayed as shown in the right drawing of FIG. 5C.

Next, the control unit 180 finally determines a quantity of laundry detergent to be input based on the detected load size and contamination level of the laundry (S40). Specifically, after determining an initial laundry detergent input quantity according to the size of the load, an additional quantity of the laundry detergent may be added to or a predetermined quantity of the laundry detergent may be removed from the initial laundry detergent input quantity based on the contamination level of the laundry. For example, after the initial input quantity has been tentatively determined to be 40 ml according to the detection of the load, if the contamination level is determined to be very low, the control unit 180 may change a final input quantity to 30 ml and automatically input 30 ml of the laundry detergent while supplying washing water.

That is, after the contamination level detection is completed, a quantity of laundry detergent to be actually input may become larger or smaller than the initial laundry detergent input quantity determined merely based on the load of the laundry, or may be maintained without change. Accordingly, an optimal quantity of laundry detergent to be automatically input can be found according to the state of the laundry.

Meanwhile, a graphic object associated with the determined laundry detergent input quantity is displayed on the touch screen 122 of the washing machine 100 (S50). The graphic object may be text, an image, a video, and a combination of two or more thereof.

In addition, the graphic object may include a first object indicating the determined laundry detergent input quantity. Alternatively, the graphic object may include a second object indicating that the laundry detergent is being introduced. In detail, a first graphic object to intuitively show a laundry detergent input quantity is displayed at the time point when the laundry detergent input quantity is determined. On the other hand, a second graphic object indicating the introduction of the laundry detergent associated with the first graphic object is displayed while the laundry detergent accommodated in the detergent supplying unit 210 is being introduced into the washing tub.

For example, in FIG. 5B, when the laundry detergent input quantity is determined, a first graphic object 502 including a detergent cup image and text by which the input quantity can be intuitively confirmed is output on the touch screen 122 as shown in the left drawing of FIG. 5B. While the laundry detergent is actually introduced, a second graphic object 503 including an animation image of inputting the detergent is output on the touch screen 122 as shown in the right drawing of FIG. 5B. While the animation image is output, a predetermined sound effect (e.g., detergent input sound) may be output together.

The second graphic object 503 may output or include an image that is changing according to a degree to which the laundry detergent contained in the detergent supplying unit 210 is input into the washing tub, for example, an animation as shown in the right drawing of FIG. 5B. Although not shown, the user may touch the corresponding image before the animation is finished to input a change command, such as stopping the laundry detergent input, additionally inputting the laundry detergent, adding, or removing some of the laundry detergent.

On the other hand, in one embodiment, a washing stroke course may be reset according to a determined laundry detergent input quantity. In detail, referring to FIG. 5D, a screen 506 displaying information related to an optimal washing stroke course based on the detected load, contamination level, and laundry detergent input quantity is displayed on the touch screen 122 of the washing machine 100. The screen 506 displays text indicating that the setting has been changed, and although not shown, a predetermined highlighting effect (e.g., color change) is output to the changed detailed stroke (e.g., the number of times of performing rinsing). Accordingly, the user can easily confirm the detailed stroke changed from the initial setting.

In addition, the user may touch one of items (contamination level, time, detergent quantity, the number of times of performing rinsing) displayed on the screen 506 to confirm related details or change individual strokes.

On the other hand, although detailed description is omitted, feedback voices or sounds corresponding to the laundry load detection, the contamination level detection, the determination of the laundry detergent input quantity, and the laundry detergent input may be output together. Accordingly, even when the user is far from the washing machine, the current operation state or stroke course can be confirmed by hearing such voice or sound.

As described above, in the embodiment according to the present disclosure, if only the washing start command is input, the quantity of laundry detergent to be automatically input can be accurately adjusted according to the state of the laundry without the user's manipulation and accordingly the optimal washing stroke course can be automatically reset. Therefore, by putting a quantity of laundry detergent suitable for the laundry, an excessive use of the detergent can be prevented and an individual stroke course can be automatically reset according to the detergent input quantity, which may result in enhancing washing efficiency.

Hereinafter, another operation related to an automatic introduction of laundry detergent and an example of changing a determined laundry detergent quantity quickly through a touch screen will be described in detail. In this regard, FIG. 6 is another exemplary flowchart illustrating an operation of the washing machine, and FIG. 7D is an exemplary view of a method of immediately changing a determined laundry detergent input quantity.

Figure 6:
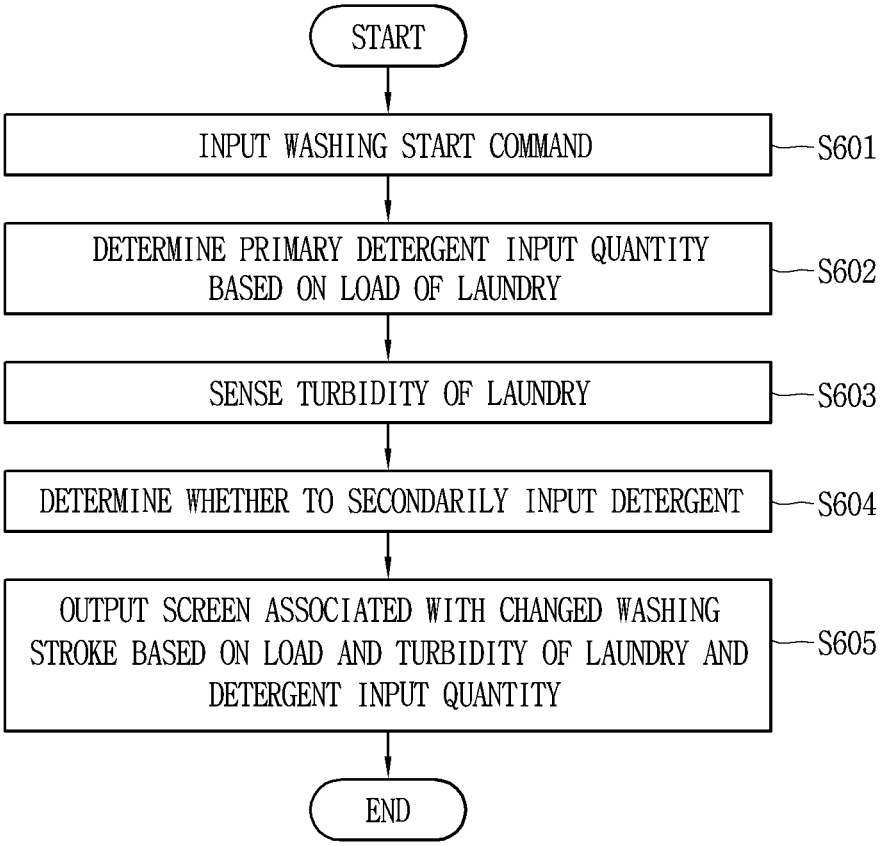
FIG. 6 is a flowchart illustrating another operation of a washing machine in accordance with one embodiment of the present disclosure.

First, referring to FIG. 6, an input of a washing start command is received (S601). The washing start command, as aforementioned, includes all the case where a push input is applied to the power button 170, the touch screen 122 is switched from an OFF state to an ON state, a home screen is output to the touch screen 122, a touch is applied to a specific function icon on a home screen, the washing machine 100 is paired with a registered user terminal, or closing of the door 120 is detected after the laundry is introduced.

Next, a load of the laundry is detected and a primary laundry detergent input quantity is determined based on the detected load (S602). Then, the laundry detergent is input into the washing tub by the determined laundry detergent input quantity. In detail, after water is supplied into the washing tub, a gear pump is turned on/off to input liquid laundry detergent corresponding to the primary detergent input quantity into the washing tub.

A size of the detected load may be evaluated in units of levels according to a predetermined reference. The level may be used as a reference for setting the number of times of detecting or sensing turbidity of the laundry corresponding to a subsequent process and a detection interval of the turbidity. The level of the load is determined as one of a plurality of levels divided into predetermined units according to the size of the load, and a value of the level of the load may be determined in proportion to the size of the load. For example, a higher level is determined when the size of the load is larger. Conversely, a lower level is determined when the size of the load is smaller.

The control unit 180 or the detergent input determination unit 182 determines an initial laundry detergent input quantity based on the size or level of the load. And while the water supply to the washing tub is carried out, the laundry detergent is put in as much as the determined initial input quantity and the washing process is executed.

Next, during the washing stroke, a contamination level, i.e., turbidity of the laundry is detected (S603). In other words, the contamination level of the laundry is measured after the laundry detergent is introduced according to the size of the load. Even in this process, the contamination level of the laundry may be detected more than once during the washing stroke. A detection result of the contamination level may also be evaluated in units of levels based on a predetermined reference. For example, the detection results of the contamination level may be classified into first to third stages depending on the contamination level of the laundry.

In addition, in one example, the control unit 180 may set differently the number of times of detecting the contamination level and the detection interval of the contamination level depending on the detected size of the load or the evaluated level of the load. For example, if a level corresponding to the load of the laundry detected in step 5602 is one of 1 to 3, the contamination level detection may be performed only three times or less in total. On the other hand, if a level of the load detected in step 5602 is one of 4 and 5, the contamination level detection may be performed four or five times or more in total, in order to obtain a more accurate detection result.

Next, the control unit 180 may determine whether to secondarily input the laundry detergent based on the detected contamination level (turbidity) (S604).

The control unit 180 may determine an additional input quantity of the laundry detergent to be secondarily input in consideration of both the contamination level of the laundry and the size of the load. For example, in the case where the contamination level of the laundry is detected as a third stage and thus the additional laundry detergent input is determined, a larger quantity of the laundry detergent may be determined to be additionally input when the level of the load is large.

In this way, when it is determined whether to secondarily input the laundry detergent, a washing stroke is changed based on the load of the laundry, the contamination level (turbidity) of the laundry, and a total detergent input quantity, and a screen related to the changed washing stroke is displayed on the touch screen 122 (S605).

The change of the washing stroke means, for example, increasing a washing time or adding, increasing, or decreasing at least one of the number of times of performing a rinsing stroke and/or rinsing of a dehydration stroke, and dehydration intensity. In addition, an adjustment of a water supply amount or an adjustment of water temperature while maintaining an individual stroke may also be included in the change of the washing stroke.

In addition, the screen related to the changed washing stroke refers to a washing progress screen in which one or more individual strokes have been changed according to the detection of the load and the contamination level of the laundry and the determination of the total detergent input quantity. In this case, another image that can be visually distinguished from an unchanged individual stroke may be output on information indicating the changed individual stroke. Here, the another image may correspond to all of an image with text in different size, an image output in a different color, or other images output with highlighting effects.

The control unit 180 may automatically adjust some individual strokes, such as increasing the number of times of performing rinsing, when the laundry detergent is determined to be additionally input. The control unit 180 may also adjust some individual strokes by itself, such as increasing the number of times of performing rinsing and dehydration intensity, even when an additional input of the laundry detergent is not needed according to the detection result of the contamination level of the laundry.

On the other hand, even after the laundry detergent input quantity is determined based on the load of the laundry and the contamination level, the user can further adjust the quantity of the laundry detergent to be automatically input through the touch screen 122. An example of this is shown in FIG. 7D.

Referring to FIG. 7D, while a graphic object 502 indicating a determined laundry detergent quantity is displayed on the touch screen 122, when a touch input is applied to a specific image, for example, a detergent cup image on the graphic object 502, the graphic object 502 is switched to a screen 502' for adjusting an input quantity of the laundry detergent. The screen 502' may display a first icon 714 for reducing a quantity of laundry detergent to be input, and a second icon 715 for adding or increasing a quantity of laundry detergent to be input.

The user may quickly and easily readjust the quantity of the laundry detergent to be input by applying a touch input to the first icon 714 or the second icon 715. At this time, the quantity of the laundry detergent to be reduced or added is cumulatively adjusted based on a touch degree of a touch input or a number of touch inputs applied to the first icon 714 or the second icon 715.

When the laundry detergent quantity is adjusted in this way, a screen indicating a changed laundry detergent input quantity may be output to the touch screen 122. In addition, when the laundry detergent quantity is adjusted in this way, individual washing strokes are further adjusted automatically. For example, the number of times of performing rinsing and a washing time may be increased, or a water temperature, a water supply amount, and the like may be further changed. Accordingly, even when the laundry detergent is additionally input manually, the laundry detergent does not remain in the laundry, and electrical energy, time, and the like can be saved when the input quantity of the laundry detergent is reduced.

Meanwhile, while the graphic object 503 (see FIG. 5B) indicating the input of the laundry detergent is displayed, when a preset touch input (for example, a long touch input) is applied to a specific image of the graphic object 503, for example, an amination image of inputting the laundry detergent, the input of the laundry detergent may be stopped. In this case, however, unlike the case where a touch input is applied to a washing stop icon ("||") displayed on the screen, the washing stroke continues. When a predetermined time elapses after the preset touch input is applied to the animation image of inputting the laundry detergent, a detergent cup image indicating 'a quantity of laundry detergent which has been introduced' relative to the quantity of the laundry detergent to be introduced may be displayed on the screen. This brings about the same effect as reducing the input quantity of the laundry detergent.

Figure 7A:
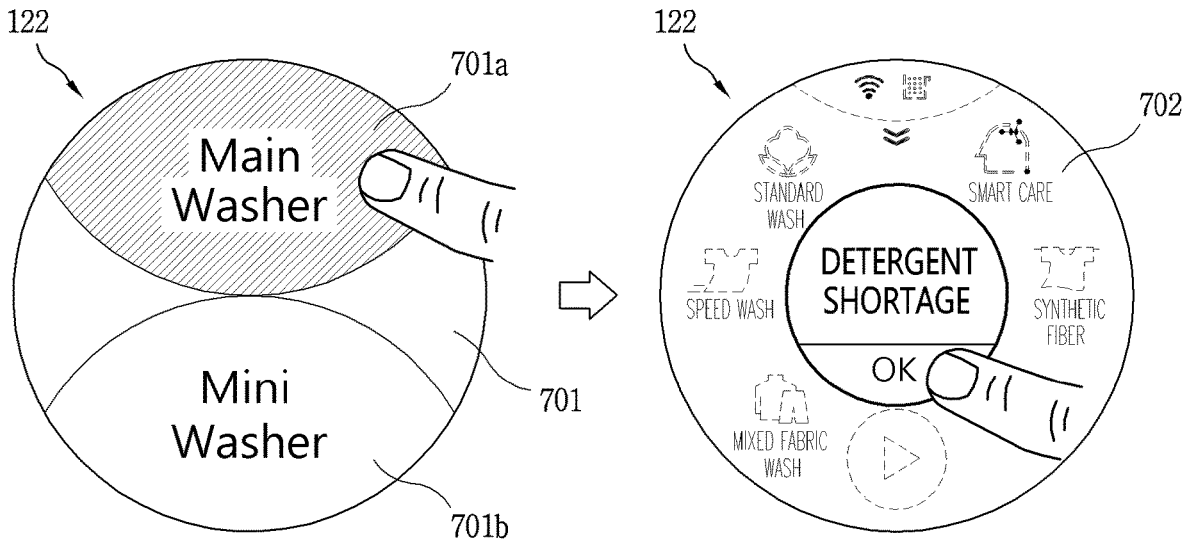
FIGS. 7A, 7B, and 7C are various exemplary conceptual views related to a method of notifying a shortage of laundry detergent in a washing machine in accordance with one embodiment of the present disclosure.
Figure 7B:
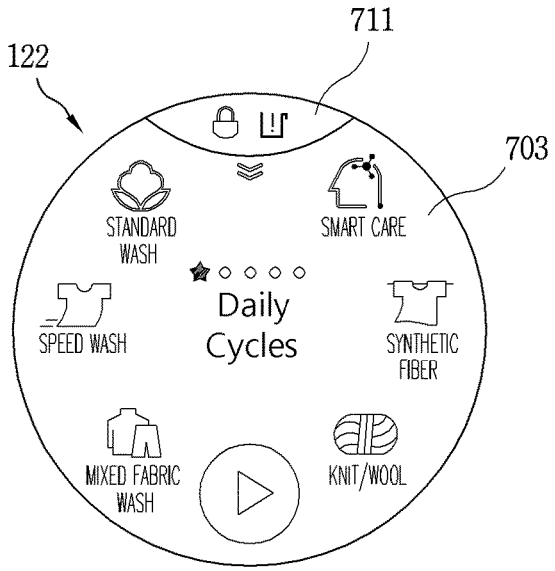
Figure 7C:
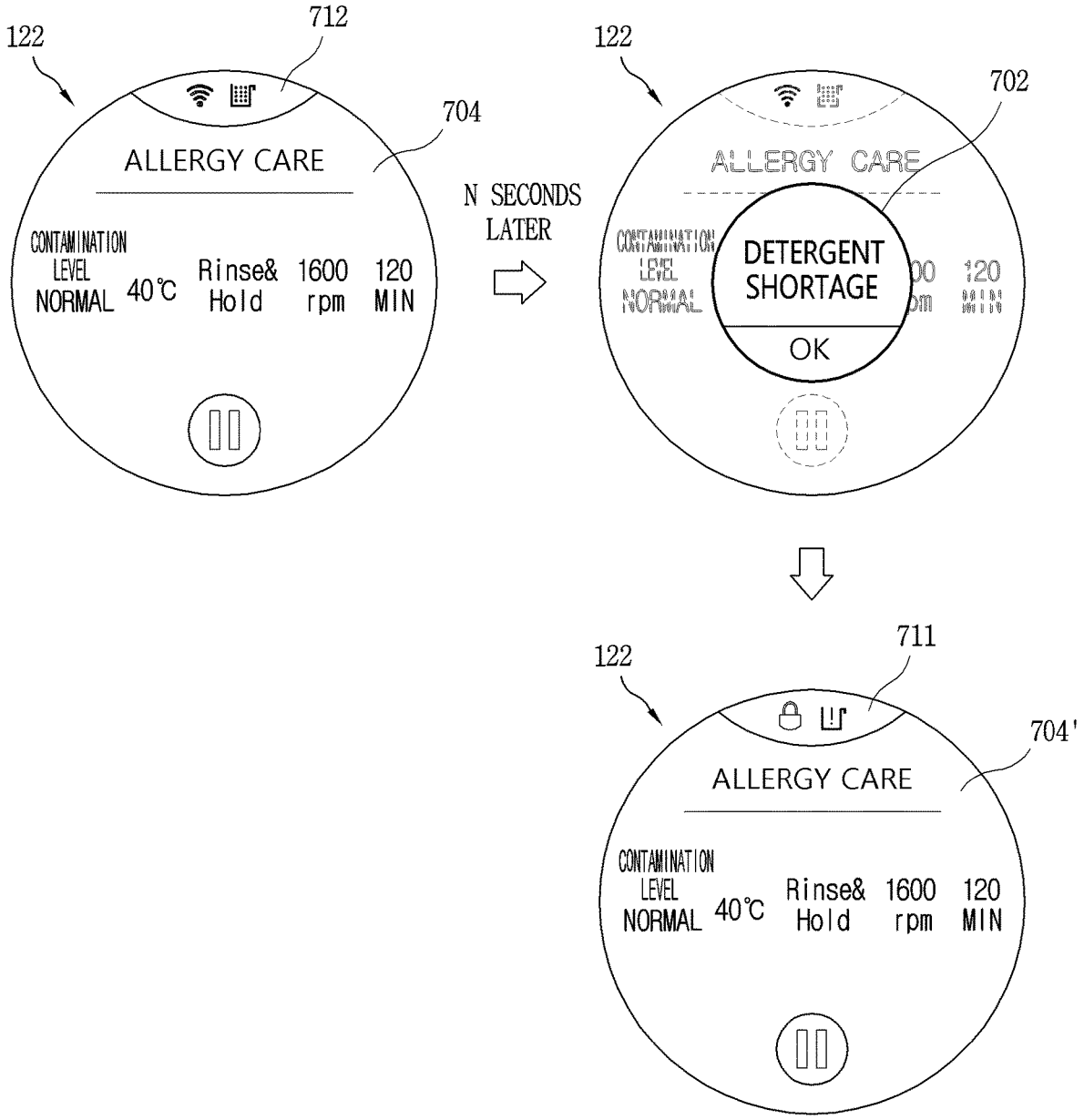
Figure 7D:
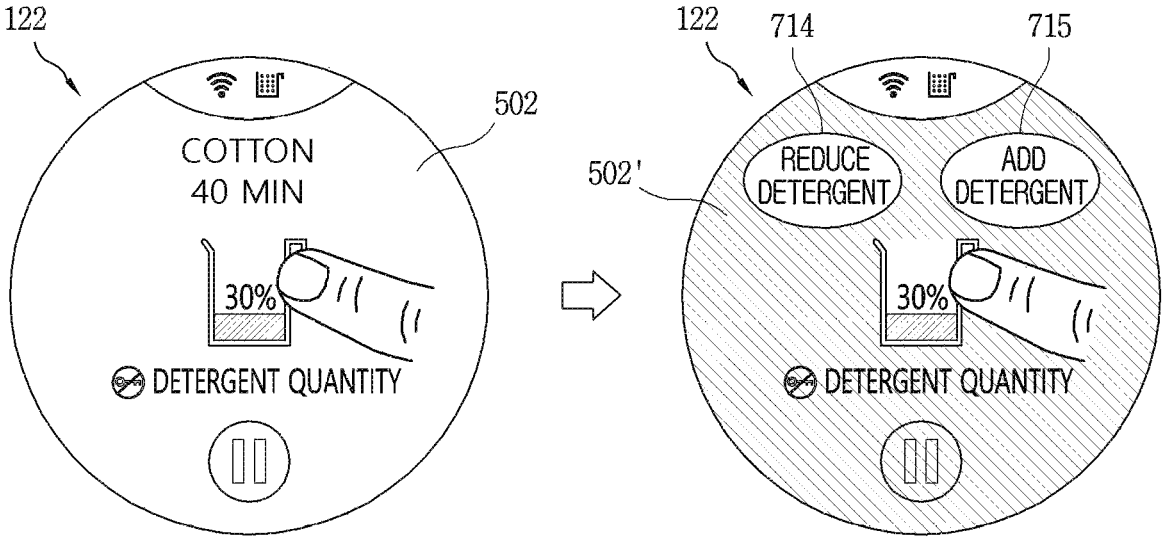
FIG. 7D is a conceptual view illustrating an exemplary method of changing a determined quantity of laundry detergent to be introduced, in a washing machine in accordance with one embodiment of the present disclosure.
Figure 8:
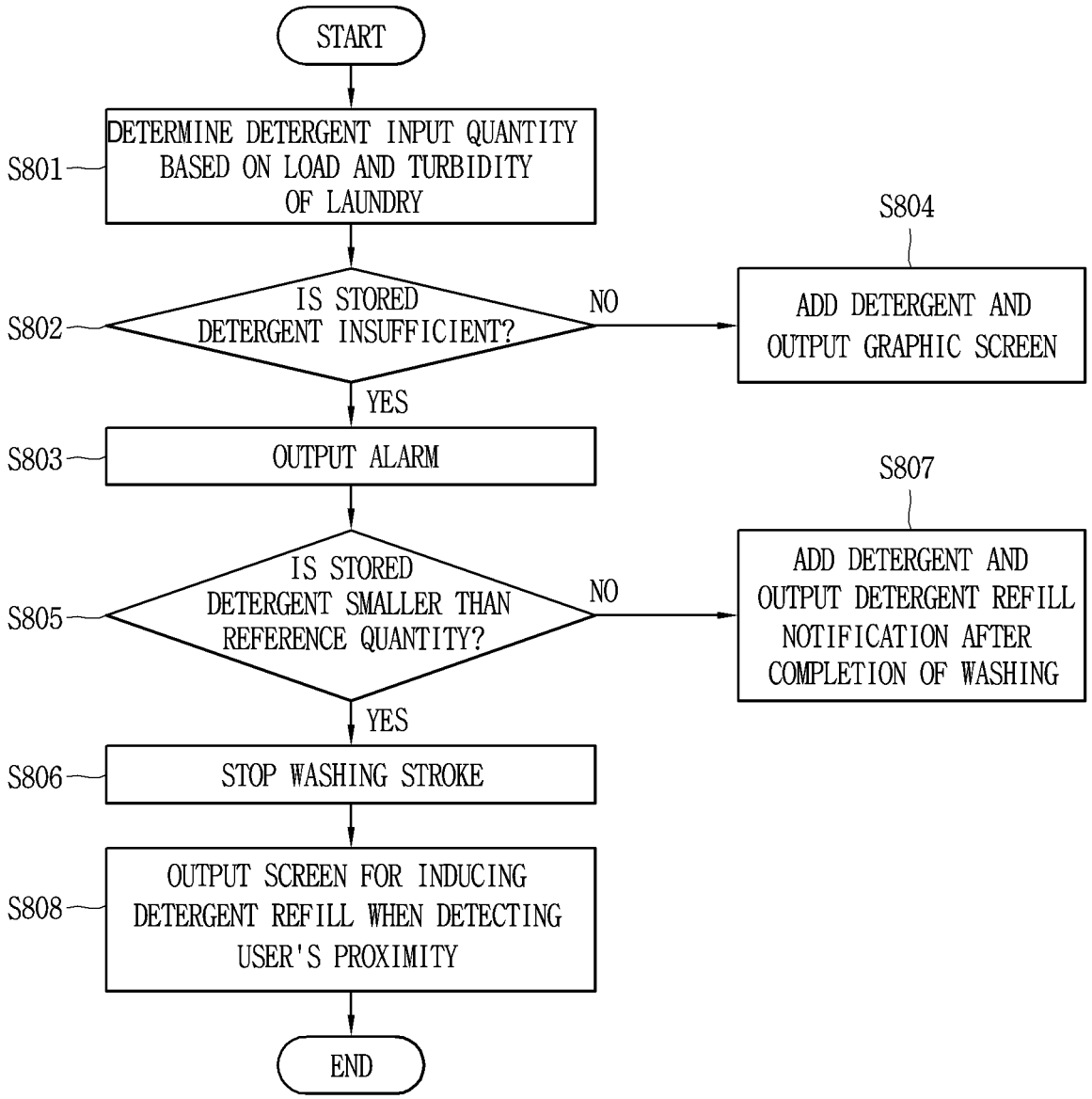
FIG. 8 is an exemplary flowchart illustrating another operation of a washing machine in accordance with one embodiment of the present disclosure.

FIGS. 7A, 7B, and 7C are various exemplary conceptual views related to a method of notifying a shortage of laundry detergent in a washing machine in accordance with one embodiment of the present disclosure. Also, FIG. 8 is an exemplary flowchart illustrating another operation of a washing machine in accordance with one embodiment of the present disclosure.

First, FIG. 7*a* is an example of providing a notification that the laundry detergent is insufficient to proceed a washing stroke by way of detecting a remaining quantity of laundry detergent contained in the storage container at the time when a laundry start command is received. In detail, the control unit 180 of the washing machine 100 may control the touch screen 122 to output information related to the remaining quantity of the laundry detergent detected through the remaining quantity detection unit, in response to the input of the washing start command.

As illustrated in FIG. 7A, when one of an image 701a of a main washer and an image 701*b* of a sub washer on a home screen 701 is selected, it may be recognized as an input of a washing start command. Accordingly, notification information 702 indicating a shortage of a remaining laundry detergent accommodated in the storage container of the detergent supplying unit 210, which is detected through the components, such as the remaining quantity detection unit, the air pocket, the pair of electrodes, or the like, may be popped up on the touch screen 122.

The notification information 702 disappears when a touch is applied to an icon 'OK' requesting confirmation of the user or when a feedback voice (e.g., 'OK') is recognized if a voice recognition function is in an activated state. As a result, the notification information 702 disappears and a washing stroke setting screen 703, which is the next step, is output to the touch screen 122 as shown in FIG. 7B. In this case, an icon 711 indicating the shortage of the remaining detergent quantity may be displayed on one area, for example, an upper end of the washing stroke setting screen 703.

Although not shown, when the user touches the icon 711, guide information to add (fill, charge) the laundry detergent or a liquid softener into the storage container of the detergent supplying unit 210 may be sequentially output to the touch screen 122. The user can easily add the laundry detergent and the liquid softener according to the guide information. In addition, when the laundry detergent is filled in the storage container of the detergent supplying unit 210, the icon 711 disappears from the screen or is switched to another icon.

On the other hand, when a reference time elapses without user confirmation after the notification information 702 has been popped up, the notification information 702 may disappear as the touch screen 122 is switched to an inactive state. In this case, when the touch screen 122 is activated, the popped-up notification information 702 may reappear.

Next, FIG. 7C illustrates an example of providing notification that the laundry detergent is insufficient during a washing stroke. For example, when a changed washing stroke screen 704 is output on the touch screen, a quantity of residual laundry detergent accommodated in the storage container of the detergent supplying unit 210 may be detected. It may take several seconds to detect the quantity of residual laundry detergent.

If the quantity of residual laundry detergent does not reach a determined laundry detergent input quantity, a pop-up message 702 notifying 'Shortage of detergent' may be displayed on a screen. Thereafter, if there is a user's feedback (e.g., touching the 'OK' icon), the pop-up message 702 disappears immediately and the washing stroke continues. Even after the pop-up message 702 disappears, a notification icon indicating the shortage of laundry detergent as shown in FIG. 7B may be continuously displayed on the upper end of the washing stroke screen 704.

On the other hand, even if there is no user's feedback (for example, touching the 'OK' icon), if the quantity of residual detergent is enough to proceed normal washing once, the washing stroke continues with the pop-up message 702 maintained. At this time, since the washing is already in progress, it is preferable to continue the washing even if there is no user's feedback about the detergent shortage notification. However, in this case, after the completion of the washing or when the door is opened or closed after the completion of the washing, the pop-up message indicating the shortage of detergent may be output once again.

FIG. 8 is a flowchart illustrating an operation of the washing machine 100 according to the present disclosure when a quantity of laundry detergent accommodated in the storage container of the detergent supplying unit 210 is insufficient after the laundry detergent input quantity has been determined.

Referring to FIG. 8, first, a quantity of laundry detergent to be input is determined based on a load and a contamination level of the laundry (S801), and then it is determined whether a quantity of laundry detergent accommodated in the storage container of the detergent supplying unit 210 is smaller than the determined laundry detergent quantity (S802). Based on this determination, it may be determined whether to continue the washing stroke. To this end, components for detecting a remaining quantity of the laundry detergent contained in the detergent supplying unit 210 are provided. In detail, the remaining quantity detection unit, the air pocket, the pair of electrodes, and the like may communicate with the passage of the detergent supplying unit 210 so that the remaining quantity of the laundry detergent can be accurately detected without an erroneous detection due to bubbles of the detergent.

When it is determined in step 5802 that the remaining quantity of the laundry detergent is sufficient (at least larger than the determined laundry detergent quantity), the laundry detergent is input by the determined laundry detergent quantity and the aforementioned graphic object is output on the touch screen (S804).

On the other hand, when it is determined in step 5802 that the remaining quantity of the laundry detergent is smaller than the determined laundry detergent quantity, predetermined alarm (notification) information is output (S803). The alarm information may be output in the form of a pop-up window on the touch screen 122. Or, it may be output with a predetermined sound or guide voice (e.g., 'Detergent is not enough.').

After the alarm information is output, the control unit 180 determines once more whether the quantity of the laundry detergent remaining in the storage container of the detergent supplying unit 210 is smaller than a reference value (S805). Here, the reference value may not be set based on the determined laundry detergent quantity, but may be a specific value determined. That is, the reference value may be a little smaller or larger than the determined laundry detergent quantity, and in general, a quantity of detergent for performing washing once may be set as the reference value.

When it is determined in step 5805 that the remaining quantity of the laundry detergent is larger than or equal to the reference value, a smaller quantity of laundry detergent, of the remaining quantity of the laundry detergent and the determined laundry detergent quantity, may be determined as an input quantity, so that the laundry detergent can be introduced by the determined input quantity. Then, when the washing is completed, a detergent addition (refill) notification is output (S807).

On the other hand, when it is determined in step 5805 that the remaining quantity of the laundry detergent is smaller than the determined laundry detergent quantity and the reference value, the washing stroke may be stopped (S806). This is because, at this time, the contamination of the laundry cannot be removed if washing is continued only with the quantity of residual detergent. However, setting may be performed based on a user input so that the washing stroke is not interrupted regardless of the quantity of residual detergent. At this time, those steps S805, S806, and S808 are omitted.

When the washing stroke is interrupted, a screen for inducing the user to add (refill) the detergent, if the user is approaching the washing machine, is displayed on the touch screen 122 (S808). Hereinafter, detailed operations related to this will be described in more detail.

Figure 9A:
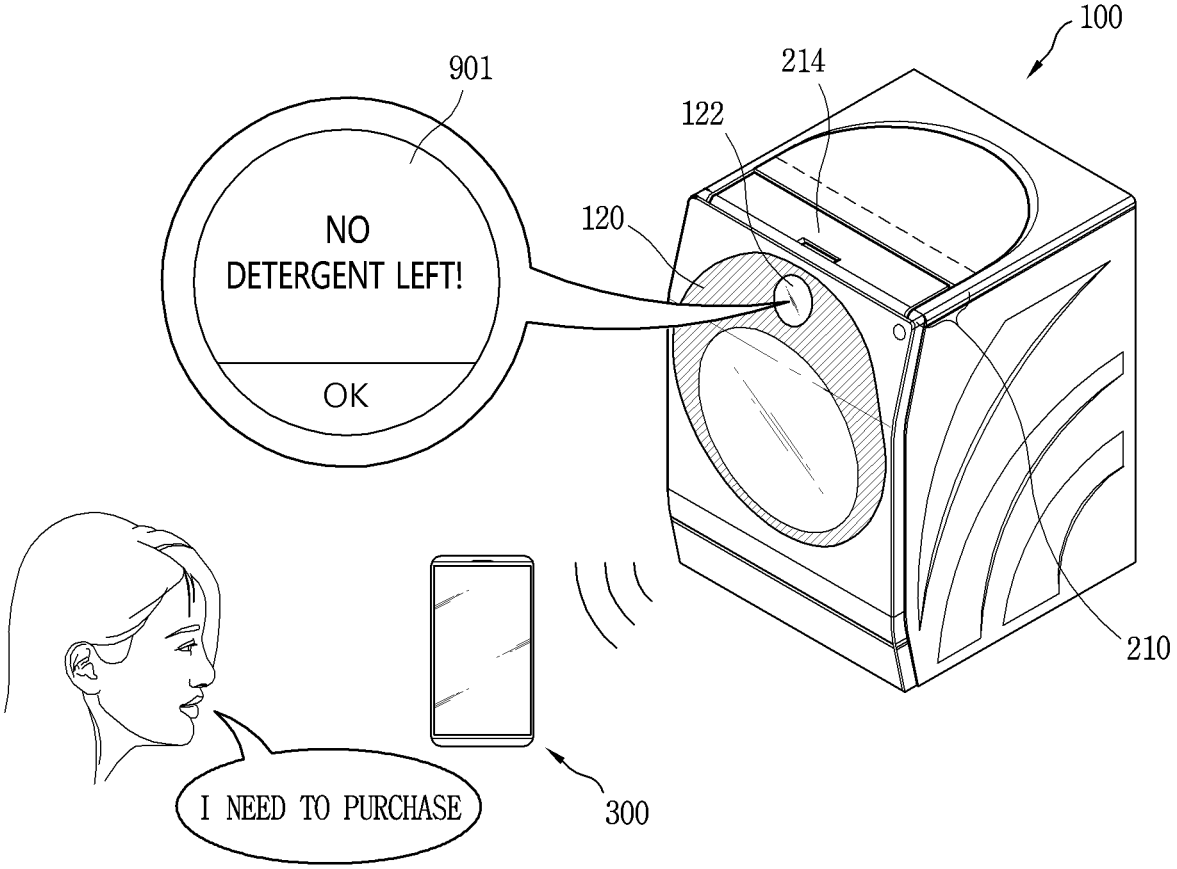
FIGS. 9A and 9B are conceptual views illustrating various examples related to an operating method when a user approaches in a situation in which a laundry detergent is insufficient in a washing machine in accordance with one embodiment of the present disclosure.
Figure 9B:
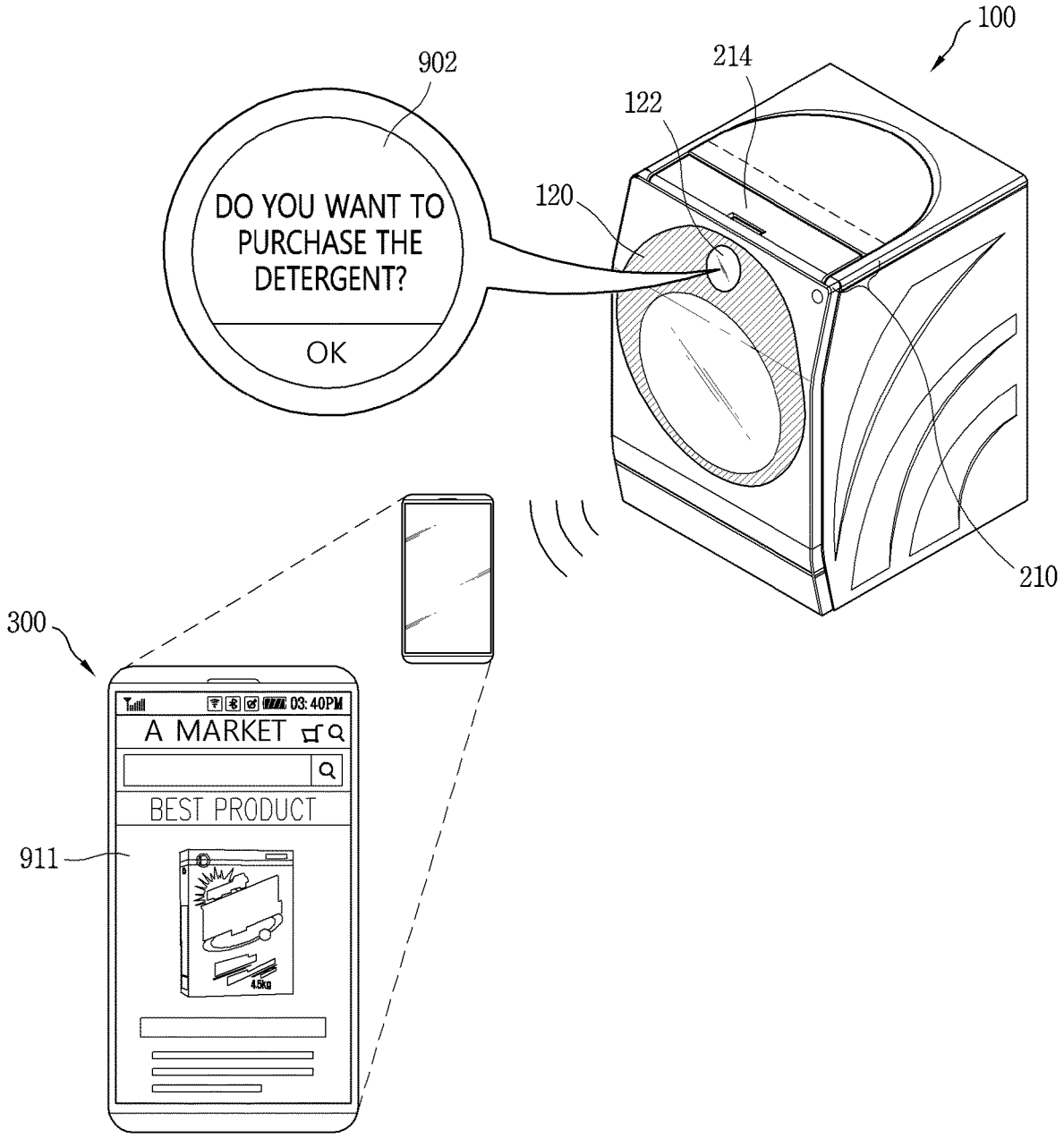

FIGS. 9A and 9B are conceptual views illustrating various examples related to an operating method when a user approaches in the case where a washing stroke is interrupted or completed under a situation in which a laundry detergent is insufficient, in a washing machine in accordance with one embodiment of the present disclosure.

To this end, the sensor unit 145 of the washing machine 100 according to the present disclosure may detect that the user is approaching the main body. When a user terminal registered in the main body of the washing machine 100 is in close proximity, the washing machine 100 and the registered user terminal may be paired through the communication unit 155 to perform communication with each other.

A component (e.g., LED) for visually outputting a response to the detection of the user's proximity or the pairing with the registered user terminal or a component (e.g., a speaker) for outputting a sound as such a response may be further provided on one side of the main body of the washing machine 100.

The control unit 180 may output, on the touch screen 122, screen information for inducing addition (refill, charge) of the laundry detergent in the detergent supplying unit 210, in response to the detection of the user approaching the main body after the washing stroke of the washing tub is stopped. Guide voice (e.g., 'Detergent is not enough') may also be output through the speaker together with the screen information. For example, as illustrated in FIG. 9A, screen information 901 outputting 'No detergent' may be output on the touch screen 122. The user may ignore or respond to the screen information.

For example, when a touch input is applied to the touch screen 122 while screen information 901 is displayed, a process of adding (refilling) detergent may be sequentially output. An initial stage of the process begins with guiding the positions of the laundry detergent accommodating portion and the softener accommodating portion within the storage container of the detergent supplying unit 210. When the user pushes upward the handle 214 of the detergent supplying unit 210 so that the door of the storage container is slidably opened, the next process may be output to the touch screen 122.

As another example, when the user's response is related to an order of detergent while the screen information 901 is displayed (e.g., 'I need to purchase), the washing machine 100 may recognize the voice feedback of the user through a voice recognition function and output a response signal. For example, as illustrated in FIG. 9B, a response message such as "Do you want to purchase the detergent?" may be output through the touch screen 122 or a similar voice guidance may be output through the speaker.

As such, when there is a positive feedback (e.g., 'Yes' or touching 'OK' icon) from the user with respect to the response signal output from the washing machine 100, the control unit 180 of the washing machine 100 transmits a control signal for outputting a screen associated with the purchase of the laundry detergent to the paired user terminal 300. The user terminal 300 which has received the control signal is automatically linked to a screen for purchasing a frequently-purchased laundry detergent by accessing a predetermined site. Accordingly, the user can easily and quickly purchase the detergent by interaction using the touch screen 122 of the washing machine 100.

As described above, according to a washing machine and a washing method according to embodiments of the present disclosure, if only a washing start command is input, the washing machine can accurately adjust by itself a quantity of laundry detergent to be automatically input, according to a state of the laundry without a user's manipulation, and accordingly can automatically set an optimal washing stroke course. Also, the user can visually and easily confirm a quantity of laundry detergent to be input and a time point when the laundry detergent is introduced during a washing stroke, through an image output on a touch screen. In addition, if necessary, the user can perform an interaction for additionally inputting detergent or taking off some of detergent by using an image output on the touch screen. When a quantity of laundry detergent stored in the washing machine is insufficient, an alarm or notification can be provided to the user so that the user can easily recognize the shortage of the detergent, and also the purchase of the laundry detergent can be guided based on the user's feedback, thereby providing a convenient environment for the user.

The present disclosure described above can be implemented as computer-readable codes on a program-recorded medium. The computer readable medium includes all kinds of recording devices in which data readable by a computer system is stored. Examples of the computer-readable medium include a hard disk drive (HDD), a solid state disk (SSD), a silicon disk drive (SDD), a ROM, a RAM, a CD-ROM, a magnetic tape, a floppy disk, an optical data storage device and the like, and may also be implemented in the form of a carrier wave (e.g., transmission over the Internet). The computer may include the control unit 180 of the terminal. The above detailed description should not be limitedly construed in all aspects and should be considered as illustrative. Therefore, all changes and modifications that fall within the metes and bounds of the claims, or equivalents of such metes and bounds are therefore intended to be embraced by the appended claims.

The invention claimed is:

1. A washing machine, comprising:

a washing tub configured to receive laundry;

a touch screen configured to output one or more graphic objects corresponding to an operation related to washing in the washing tub;

a detergent supply that defines an inner space configured to accommodate a laundry detergent and that is configured to supply the laundry detergent to the washing tub;

a sensor configured to detect a remaining quantity of the laundry detergent in the detergent supply; and a control unit that is configured to:

detect a load of the laundry in the washing tub and a contamination level of the laundry in response to an input of a washing start command, determine an input quantity of the laundry detergent based on the load of the laundry and the contamination level of the laundry, control the touch screen to display a graphic object corresponding to the input quantity of the laundry detergent, supply the input quantity of the laundry detergent to the washing tub to continue a washing stroke of the washing tub based on the remaining quantity of the laundry detergent being greater than or equal to a reference value, and control the touch screen to output a notification for adding the laundry detergent after completion of the washing stroke.

2. The washing machine of claim 1, wherein the touch screen is configured to:

display a first graphic object at a time point at which the input quantity of the laundry detergent is determined; and display a second graphic object associated with the first graphic object while the laundry detergent is supplied into the washing tub.

3. The washing machine of claim 2, wherein the second graphic object comprises an image that is configured to change based on an amount of the laundry detergent supplied into the washing tub.

4. The washing machine of claim 1, wherein the control unit is configured to:

determine an initial input quantity of the laundry detergent based on the load of the laundry, and determine whether to additionally supply the laundry detergent to the washing tub based on the contamination level of the laundry.

5. The washing machine of claim 1, wherein the control unit is configured to change the washing stroke based on the input quantity of the laundry detergent, the load of the laundry, and the contamination level of the laundry.

6. The washing machine of claim 5, wherein the control unit is configured to output screen information corresponding to the changed washing stroke on the touch screen.

7. The washing machine of claim 1, wherein the control unit is configured to change a quantity of the laundry detergent to be supplied to the washing tub in response to a touch input applied to the graphic object corresponding to the input quantity of the laundry detergent.

8. The washing machine of claim 1, wherein the control unit is configured to:

based on the input quantity of the laundry detergent and the remaining quantity of the laundry detergent, determine whether the laundry detergent is insufficient to be supplied into the washing tub, and determine whether to continue the washing stroke based on the determination of whether the laundry detergent is insufficient to be supplied into the washing tub.

9. The washing machine of claim 8, wherein the control unit is configured to:

stop the washing stroke of the washing tub based on the remaining quantity of the laundry detergent being less than the reference value.

10. The washing machine of claim 9, further comprising a proximity sensor that is configured to detect a user's proximity to the washing machine, wherein the control unit is configured to, in response to the proximity sensor detecting the user's proximity after the washing stroke of the washing tub is stopped, output, to the touch screen, screen information for adding the laundry detergent into the detergent supply.

11. The washing machine of claim 10, further comprising a communication device configured to perform communication with a user terminal, wherein the control unit is configured to, in response to the proximity sensor detecting the user's proximity after the washing stroke of the washing tub is stopped, control the communication device to transmit a control signal to the user terminal to display a screen related to a purchase of the laundry detergent through a user feedback on the user terminal.

12. A method for operating a washing machine having a touch screen, the method comprising:

detecting a load of laundry received in a washing tub of the washing machine and a contamination level of the laundry based on an input of a washing start command;

determining an input quantity of laundry detergent to be supplied from a detergent supply into the washing tub based on the load and the contamination level;

displaying a graphic object corresponding to the input quantity of the laundry detergent on the touch screen;

detecting a remaining quantity of the laundry detergent in the detergent supply;

outputting information related to the remaining quantity of the laundry detergent on the touch screen in response to the input of the washing start command;

comparing the remaining quantity of the laundry detergent to a reference value;

based on the remaining quantity of the laundry detergent being greater than or equal to the reference value, supplying the input quantity of the laundry detergent to the washing tub to continue a washing stroke; and controlling the touch screen to output a notification to add the laundry detergent after completion of the washing stroke.

13. The method of claim 12, wherein displaying the graphic object comprises:

displaying a first graphic object at a time point at which the input quantity of the laundry detergent is determined; and displaying a second graphic object associated with the first graphic object while the laundry detergent is supplied into the washing tub.

14. The method of claim 13, wherein displaying the second graphic object comprises changing an image on the touch screen based on an amount of the laundry detergent supplied into the washing tub.

15. The method of claim 13, further comprising:

stopping the washing stroke based on the remaining quantity of the laundry detergent being less than the reference value;

detecting, by a proximity sensor, a user's proximity to the washing machine after the washing stroke of the washing tub is stopped; and in response to detecting the user's proximity after the washing stroke of the washing tub is stopped, outputting, to the touch screen, screen information to add the laundry detergent into the detergent supply.

16. The washing machine of claim 1, wherein the control unit is configured to, based on a determination that the laundry detergent is sufficient to be supplied into the washing tub, supply the input quantity of the laundry detergent to the washing tub.

17. The washing machine of claim 1, wherein the control unit is configured to:

compare the remaining quantity of the laundry detergent to the input quantity of the laundry detergent;

based on the remaining quantity of the laundry detergent being less than the input quantity of the laundry detergent, compare the remaining quantity of the laundry detergent to the reference value, wherein the reference value is less than the input quantity of the laundry detergent; and perform the washing stroke of the washing tub based on the remaining quantity of the laundry detergent being greater than or equal to the reference value.

18. The washing machine of claim 1, wherein the control unit is configured to stop the washing stroke of the washing tub based on the remaining quantity of the laundry detergent being less than both of the input quantity of the laundry detergent and the reference value.

19. The method of claim 12, further comprising:

comparing the remaining quantity of the laundry detergent to the input quantity of the laundry detergent;

based on the remaining quantity of the laundry detergent being less than the input quantity of the laundry detergent, comparing the remaining quantity of the laundry detergent to the reference value, wherein the reference value is less than the input quantity of the laundry detergent; and performing the washing stroke of the washing tub based on the remaining quantity of the laundry detergent being greater than or equal to the reference value.

20. The method of claim 12, further comprising:

stopping the washing stroke of the washing tub based on the remaining quantity of the laundry detergent being less than both of the input quantity of the laundry detergent and the reference value.

* * * * *